US009677772B2

(12) United States Patent
Siegel et al.

(10) Patent No.: US 9,677,772 B2
(45) Date of Patent: Jun. 13, 2017

(54) INTELLIGENT VENTILATING SAFETY RANGE HOOD CONTROL SYSTEM

(71) Applicant: Rain Mountain, LLC, Rochester, NY (US)

(72) Inventors: Robert Siegel, Rochester, NY (US); Robert Lewandowski, Webster, NY (US)

(73) Assignee: Rain Mountain, LLC, Rochester, NY (US)

( * ) Notice: Subject to any disclaimer, the term of this patent is extended or adjusted under 35 U.S.C. 154(b) by 689 days.

(21) Appl. No.: 13/772,902

(22) Filed: Feb. 21, 2013

(65) Prior Publication Data

US 2014/0230662 A1 Aug. 21, 2014

(51) Int. Cl.
*F24C 15/20* (2006.01)
*F24F 7/00* (2006.01)

(52) U.S. Cl.
CPC ..... *F24C 15/2021* (2013.01)

(58) Field of Classification Search
CPC ..... F24C 15/2021; F23L 17/005
USPC ..... 126/299 R; 454/61
See application file for complete search history.

(56) References Cited

U.S. PATENT DOCUMENTS 2,242,278 A * 5/1941 Yonkers, Jr. ..... A47L 9/125 15/327.6
2,658,665 A * 11/1953 Tschudy ..... A47L 5/22 417/366
4,641,571 A * 2/1987 Anderson ..... F24F 7/025 454/19
4,784,114 A * 11/1988 Muckler ..... F24C 15/20 126/299 D
5,310,110 A 5/1994 Akamatsu et al.
5,611,327 A 3/1997 Teixeira Filho et al.
5,839,374 A * 11/1998 Conner ..... F04D 23/001 110/162
6,753,511 B2 6/2004 Mathews, Jr. et al.
6,920,874 B1 * 7/2005 Siegel ..... F24C 15/2021 126/21 A
6,966,830 B2 * 11/2005 Hurlstone ..... B60H 1/00471 417/363
7,320,636 B2 * 1/2008 Seliger ..... B08B 15/002 126/299 F
7,866,312 B2 * 1/2011 Erdmann ..... F24C 3/12 126/299 D
8,312,873 B2 * 11/2012 Gagas ..... F24C 15/2035 126/299 D
8,734,210 B2 * 5/2014 Burdett ..... F24C 15/2021 126/299 D
8,795,040 B2 * 8/2014 Burdett ..... F24C 15/2021 250/334

(Continued)

*Primary Examiner* — Steven B McAllister
*Assistant Examiner* — Jonathan Cotov
(74) *Attorney, Agent, or Firm* — Simpson & Simpson, PLLC

(57) ABSTRACT

An improved control system for a range hood that is capable of automatically responding to various air quality parameters including heat, smoke, carbon monoxide, humidity, and others. The system contains a number of features that, combining aspects of open-loop and closed loop control, manage the system dynamics for smoother operation, respond to both level and rate signals and compensate for background conditions and sensor variability by using relative values.

17 Claims, 19 Drawing Sheets

(56) References Cited

U.S. PATENT DOCUMENTS

| | | | | |
|---|---|---|---|---|
| 2004/0072535 | A1* | 4/2004 | Schneider | F24F 11/0001 454/229 |
| 2005/0173404 | A1 | 8/2005 | Benjamin et al. | |
| 2005/0224069 | A1* | 10/2005 | Patil | F24C 15/2021 126/299 D |
| 2006/0234621 | A1* | 10/2006 | Desrochers | F24F 3/044 454/239 |
| 2006/0278216 | A1* | 12/2006 | Gagas | F24C 15/2028 126/299 D |
| 2008/0029081 | A1* | 2/2008 | Gagas | F24C 15/2035 126/299 D |
| 2009/0048714 | A1* | 2/2009 | Hanawalt | G05D 23/2415 700/275 |
| 2009/0215439 | A1* | 8/2009 | Hamilton | H04M 1/605 455/418 |
| 2009/0258331 | A1 | 10/2009 | Do et al. | |
| 2010/0046766 | A1* | 2/2010 | Gregg | H04R 3/12 381/59 |
| 2011/0050428 | A1* | 3/2011 | Istoc | G06F 19/345 340/573.1 |
| 2014/0048293 | A1 | 2/2014 | Luongo et al. | |

* cited by examiner

C2

INTELLIGENT VENTILATING SAFETY RANGE HOOD CONTROL SYSTEM

FIELD OF THE INVENTION

This disclosure relates to the field of mechanical ventilation of enclosed, inhabited spaces and in particular, the ventilation of a kitchen where food is being cooked on a stove creating undesirable heat, moisture and airborne contaminants.

U.S. Pat. No. 6,920,874 by the same inventor describes an enhanced range hood with a control system that effectively modulates the speed of the exhaust fan in response to multiple air quality parameters. This disclosure extends the functionality of that disclosure incorporating a number of details that lead to improvements in the overall performance of the system. U.S. Pat. No. 6,920,874 entitled INTELLIGENT VENTILATING SAFETY RANGE HOOD is hereby incorporated by reference in its entirety.

BACKGROUND OF THE INVENTION

Modern homes are being built with increasing emphasis on energy efficiency. This generally means more thermal insulation, more vapor barriers and better quality seals around windows and doors. This type of construction has given rise to the concern that ventilation may be inadequate, in light of the need for a continuous supply of fresh air and concerns about volatile byproducts of manufacturing of synthetic items. There is further concern in the many homes that use combustible fuels for heating and cooking or lighting. In addition to the psychometric comfort factors of heat and humidity and the essential need for oxygen, there are the serious health factors of carbon monoxide, smoke, and any other products of combustion deriving from these combustion process. Excess heat and humidity in an enclosed structure can also be quite destructive to the structure itself, leading to problems ranging from mildew, to insulation failure, to deterioration of the actual structure itself through attraction of insects and rot. In the case of electric stoves, there are also harmful effluents emitted as the results of the cooking process.

As of 2011, there were anywhere between 200 and 700 annual deaths attributed to residential, non-vehicle, carbon monoxide (CO) poisoning in the US. While equipment malfunctions, such as cracked heat exchangers played a role, a key factor in all of these injuries and deaths was inadequate ventilation. Roughly 10% of these casualties have been attributed to gas stoves and ovens. Low-level cases are more difficult to track, since the symptoms are similar to common cold or flu, but are likely to have a much higher occurrence. Thus, considering the impact of lost work days and reduced activity due to illness for low-level exposure, and the injury and death resulting from high level exposure, the cost to society of inadequate ventilation in conjunction with combustion appliances is substantial.

The ASME standards for gas stoves, which allow for trace amounts of CO, are based on the assumption that the stoves are vented. However, many are not and even those that are generally use a range hood with a fan that must be switched on manually. Many people do not turn these venting fans on unless there is detectable smoke or odor or if the kitchen becomes excessively hot. In other words, kitchens are often inadequately ventilated to a degree that may be a health and safety concern.

Carbon monoxide, being colorless and odorless is undetectable without some sort of sensing device. It is unlikely that CO being emitted by a cooking appliance will be detected by plug-in detectors since the installation instructions for these devices recommend placing them a minimum distance away from such appliances so as to avoid setting off an alarm due to transient levels emitted from said cooking appliances. In any case, while the alarms are useful for notifying building occupants of the hazard, they do nothing beyond this to ameliorate the situation. The same is true for smoke detectors.

Experts say that American households in general and kitchens in particular are seriously under-ventilated. Many homes are constructed with hoods that do not vent outdoors, and many people do not use their hoods routinely when cooking. They don't like the noise, or the fact that the hoods use extra power and remove conditioned air from the house. When they do use them, they often leave the room and forget to turn them off, which can waste a good deal of additional energy both from the fan itself and the loss of heated or cooled air.

A variety of range hoods have been developed in an attempt to provide ventilation of cooking-related exhaust fumes and other volatile waste products. Different designs are utilized including hoods mounted under cabinets, island hoods and down-drafting hoods that pull fumes from below. The vast majority are manually controlled and will not activate unless the user takes action. A few have implemented fairly simplistic automatic controls such as a single point temperature switch that turns the fan on at maximum speed when excessive temperature, smoke or fumes are detected. Others designed to operate in a commercial environment, vary fan speed in response to effluent factors but cannot turn the fan off due to health code and other restrictions that are unique to a commercial cooking environment. Since, in the commercial environment, the fan is always running at some ventilation level, there is no need for detection of small quantities of hazardous chemicals like carbon monoxide. This means that they can function satisfactorily with a far more simplistic detection scheme than what is required in the residential environment. While these and other devices represent improvements in the art of ventilating heat and fumes generated by cooking, they either do not adequately address the health and safety concerns described above, or they lack the sophistication that will allow them to fit seamlessly into a modern household without being disruptive.

One reason that automatic range hood controls have not yet been popularized is because designing one that works effectively is difficult. Unlike a household furnace, whose thermostat can effectively control the temperature in the house since it controls the source of the heat, a range hood controller has no control over the source of the heat or the fumes or the steam. Therefore it must react without knowledge of what the stove is doing or whether the heat or smoke it just detected is increasing, decreasing or being produced at a steady rate. This is exacerbated by the fact that once the fan is running, it is difficult to tell what is happening below. This makes it particularly problematic to determine when it is time to turn the fan off. Conventional approaches might tend towards a timer-based approach (open loop), which essentially guesses how long the cooking episode will last, and thus runs the risk of either terminating ventilation prematurely, leading to the possibility of spillage of smoke or fumes, or running too long, on the other hand, thereby wasting energy.

Conversely, a closed-loop approach that relies solely on the sensors will likely need to turn the fan off in order to see if more smoke and heat are still coming up. This could lead to a lot of rapid up and down cycling of the fan during the cooking process that, since it is in the kitchen, a place where people often assemble, could be considered objectionable on account of the rapidly changing noise level.

Understanding this shows why a simple temperature set level control like the type used on a furnace, even with hysteresis built in will not be sufficient.

The problem of knowing when to automatically turn a ventilation hood on and off is sometimes addressed by means of a direct electrical connection between the stove and hood, or the use of some external device that could be attached to the stove to determine whether or not gas or electricity is flowing, or even an AC coupling scheme that transmits signals through household wiring. This however, has the drawback of added cost and complexity and the fact that most hoods and stoves are not designed to operate together. Furthermore, even if the amount of gas or electricity could be measured, that would still not directly correlate with the need for ventilation, to be able to distinguish, for example, between a pan full of food that is burning and giving off smoke, and a tea kettle that is simply heating up.

In order to provide optimal performance, it is ideally useful to know precisely, the amount of ventilation required, so as to avoid over-ventilation which can waste a good deal of energy.

For these reasons, plus, for simplicity of installation, a self-contained hood system with a controller that will be able to not only detect the need for ventilation but to determine the amount of ventilation required at any point before, during, or after the cooking process might be desirable.

Such a system would need to address several considerations. First, it would be likely to require some means to determine the dynamic ventilation requirement. This can be accomplished by means of air quality sensors that can assess not only the operating state of the stove, but also the amount of undesirable byproducts being produced. The placement of these sensors can be important in the operation of the hood. Placing them in direct communication with the ventilation air stream provides the most responsive performance, though care would need to be taken to dampen the effect of relatively abrupt changes in temperature or contaminant levels as the fan turns on which might otherwise lead to unstable performance. Response time is also quite important, so that the fan becomes activated before contaminants begin spilling out of the hood.

There is also the question of environmental variability. A robust automatic hood controller would need to function in a wide variety of geographies exhibiting a wide range of background temperature, humidity and contaminant levels. A controller that responds to a fixed preset temperature level or a fixed contaminant level, will perform differently in different environmental settings producing less than ideal results under non-standard conditions.

The above-mentioned considerations suggest the need for a device to address these concerns, that would provide an effective, self-contained, inexpensive, convenient, non-intrusive automated response to the presence of the air quality factors such as heat, humidity, CO and smoke and fumes or other similar hazards in a kitchen as the result of cooking or introduced by some other means, independent of background conditions.

Such a device might also include an alarm feature. There are, of course, various types of smoke and carbon monoxide detectors. These devices are sensitive to the presence of the hazards they are intended to detect and are designed to emit a loud audible alarm when a predetermined level of hazard has been detected. This is, of course, useful and has in many cases saved lives, but there are other cases where they have not been effective. Having the ability to take action beyond emitting an alarm, by, for example, providing ventilation could also prove useful.

In providing this capability in conjunction with a ventilation device that is located in very close proximity to where people are cooking, it might be helpful to be able to automatically adjust the volume level of the alarm so as not to be able to provide the necessary function without being overwhelming.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

BRIEF SUMMARY OF THE INVENTION

The disclosure describes a number of enhancements to a conventional stove hood, or range hood to increase its effectiveness, ensure its proper utilization and increase its energy efficiency by means of an automatic controller.

The automatic controller consists of some number of air quality sensors that might include temperature and smoke, at a minimum, as well as humidity, gas, and others for enhanced performance, and well as the electronic circuits capable of capturing and conditioning the signals from those sensors so as to provide input to a microcontroller, a set of software instructions for the microcontroller to interpret the signals and generate responses by controlling both the ON/OFF state of the fan as well as its speed, and the electric circuitry necessary to drive an electric (AC, DC or EC) fan.

The art described herein addresses solutions to certain key issues that arise in the implementation and development of a smart hood controller that fall variously under the heading of operability, environmental variability, sensor variability, minimization of undesirable effects such as noise and energy loss, and overall system performance.

The disclosure describes a way of managing the dynamic timing of the fan control, by means of software so as to provide smooth behavior that will not be considered "jerky" or intrusive to the user. In some cases, for example, fan operation is initiated when a guard band threshold level has been reached for any parameter. The software ensures that the fan will remain ON for a minimum length of time. This capability is enabled through a set of software routines for heat, smoke, etc., that control the fan in response to a fixed threshold level being reached. The software also continues to monitor the sensors throughout the run time so that if the fan speed needs to be increased, it will do so.

The disclosed controller addresses the question of sensitivity loss when the fan is running by gradually reducing the fan speed to the point where it can effectively resample the air quality coming into the hood. This scheme, which combines elements of both open-loop and closed-loop control, provides a smoother and more efficient operation, since the fan remains ON at low speed, while the controller continues to sample and respond to changes in the air quality until it has determined that cooking has concluded. This capability is contained in a set of software routines for heat, smoke, etc., specific to the task of ramping down the hood operation where it appears that cooking has been completed. By reducing fan speed and turning the fan OFF in a timely manner, energy savings are achieved.

As to the question of environmental variability, the present disclosure describes a control system that replaces the fixed levels for each air quality threshold, with a "learning" scheme that adjusts itself to its surroundings in two ways.

First, by sampling the background level during idle periods, it establishes reference levels for each parameter, relative to which guard band levels are computed. This is accomplished by means of a series of software routines for heat, smoke, etc., that run during idle periods and are assigned to the task of establishing the ambient conditions so that threshold trigger levels can be set relative to those.

Secondly and independently, the system responds to rates of change in each parameters rather than only absolute fixed values. So, a rate of change condition will also trigger a fan response, regardless of whether a guard band level has been reached. This rate-detection approach is used to effectively respond to differential rates of air contamination rather than fixed levels. In this case the response is proportional to the rate of change. This capability is provided by means of a set of software routines for heat, smoke, etc., that control the fan in response to a detected rate of change.

The controller also contains an optional audible alarm feature. This can be helpful under a high smoke condition, though it can also be annoying, If the customer is cooking some smoky food, he or she would not want a loud alarm going off in his or her face. Therefore a motion detector is employed to determine whether or not a person is standing in front of the stove and adjust the alarm volume and behavior accordingly. This feature is accomplished by means of a software routine that adjusts the volume of the audible alarm in response to the presence of a person in proximity to the stove as determined by a motion detector or other means of determining whether the space around the stove is occupied.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages that are included within this description, be within the scope of any claims filed later.

BRIEF DESCRIPTIONS OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

In the FIGURES, like elements should be understood to represent like elements, even though reference labels are omitted on some instances of a repeated element, for simplicity.

DETAILED DESCRIPTION OF ILLUSTRATIVE EMBODIMENTS

Figure 1:
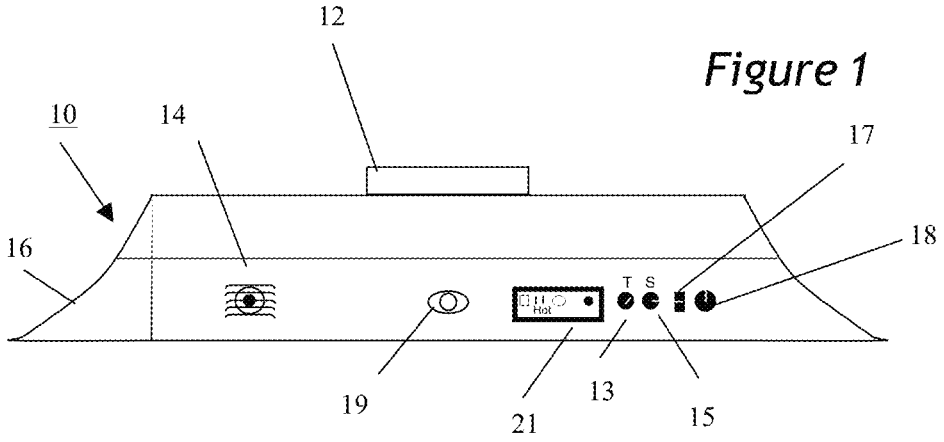
FIG. 1 is an elevation view of a typical overall smart hood embodiment.

Reference now should be made to the drawings, in which the same reference numbers are used throughout the different figures to designate the same components.

For the reasons described above, plus, for simplicity of installation, a self-contained hood system with a controller that will be able to not only detect the need for ventilation but to determine the amount of ventilation required at any point before, during, or after the cooking process might be desirable.

Such a system would need to address several considerations. First, it would be likely to require some means to determine the dynamic ventilation requirement. This can be accomplished by means of air quality sensors that can assess not only the operating state of the stove, but also the amount of undesirable byproducts being produced. The placement of these sensors can be important in the operation of the hood. Placing them in direct communication with the ventilation air stream provides the most responsive performance, though care would need to be taken to dampen the effect of relatively abrupt changes in temperature or contaminant levels as the fan turns on which might otherwise lead to unstable performance. Response time is also quite important; the fan needs to become activated before contaminants begin spilling out of the hood.

There is also the question of environmental variability. A robust automatic hood controller would need to function in a wide variety of geographies exhibiting a wide range background temperatures, humidity and contaminant levels. A controller that responds to a fixed preset temperature level or a fixed contaminant level, will perform differently in different environmental settings producing less than ideal results under non-standard conditions.

Another consideration would be sensor drift over time, either through deterioration or wear of the sensing elements or in an operating environment such as this, by contamination by such factors as grease, dirt, etc, that can accumulate on the sensor surfaces, resulting in changes to their response characteristics. A controller with the capability of auto-calibration can continuously adjust for these changes, and compensate for them to ensure consistent performance over long periods of time.

A robust hood control system would also be expected to function equivalently in conjunction with a variety of different stove types, such as gas, electric, convection, etc., with different heat output and fume generation rates, requiring a wide range of performance characteristics in order to meet the intended design objectives.

The above-mentioned considerations suggest the need for a device to address these concerns, that would provide an effective, self-contained, inexpensive, convenient, self-adjusting, non-intrusive automated response to the presence of the air quality factors such as heat, humidity, Carbon monoxide, smoke and fumes or other similar hazards in a kitchen as the result of cooking or introduced by some other means, independent of background conditions.

Such a device might also include an alarm feature. In providing this capability in conjunction with a ventilation device that is located in very close proximity to where people are cooking, it might be helpful to be able to automatically adjust the volume level of the alarm so as to be able to provide the necessary function without being overwhelming. Otherwise there might be a tendency on the part of the customer to disable the alarm.

In FIG. 1 we see one embodiment of the controller embedded in a range hood assembly 10, in which the hood enclosure 16, is vented outdoors through the vent outlet 12. Other embodiments could include any of several hood configurations, such as a freestanding hood, downdraft hood, etc. The fan can operate in the automatic or manual mode as determined by the position of the Auto/Manual switch 17. In the Manual mode, the speed is controlled by the speed control knob 18. In some embodiments, the functions of the control knob 18 and the Auto/Manual switch 17 may be replaced by digital controls. In some embodiments, sensitivity controls for Temperature 13, Smoke 15, or other air quality parameters could be added to allow the customers to individually adjust the responsiveness of the automatic control system for each parameter. Alternatively, a single sensitivity control could be used to adjust the overall sensitivity. In some embodiments, the unit may also be equipped with an audible alarm 14 to notify users if there is a hazardous condition and a motion detector 19 to determine if anyone is standing in front of the stove. This information may be used to adjust the behavior of the alarm or to provide other features. An LCD display panel 21 provides textual information to notify the user of the operational state of the hood, and what hazards it is responding to. While an LCD display panel 21 is used in this embodiment, other embodiments may use other display panels, for example, one or more LEDs, an analog display panel, etc. Further, the location, placement and orientation of the features shown in FIG. 1 may differ in other embodiments.

Figure 2:
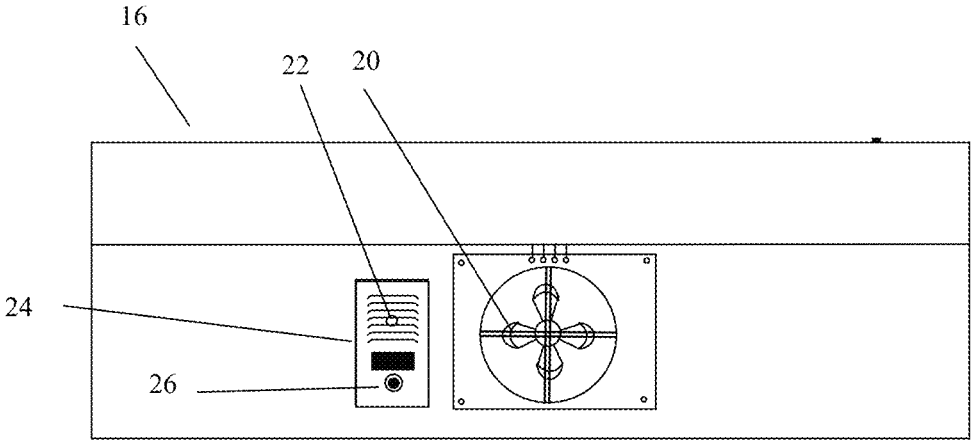
FIG. 2 is a plan view looking up from underneath the hood so that the fan can be seen.

FIG. 2 shows one embodiment of the underside of the hood assembly 16. The fan 20 is driven by the fan control module 24, which contains a temperature sensor 22 and an air quality sensor 26 in Auto mode. Other embodiments could include multiple fans. The air quality sensor 26 is capable of detecting the presence of smoke, carbon monoxide and other organic compounds and it provides an output signal that is proportional to the amount of smoke and/or pollution in the air. While this embodiment shows the sensors contained within the module, they could also be located remotely and connected to the module through wires or wirelessly. The location of the sensors is important as it can affect the response time, the operational dynamics and the overall sensitivity of the system. In this embodiment, the sensors are placed directly in contact with the air flow.

Figure 3:
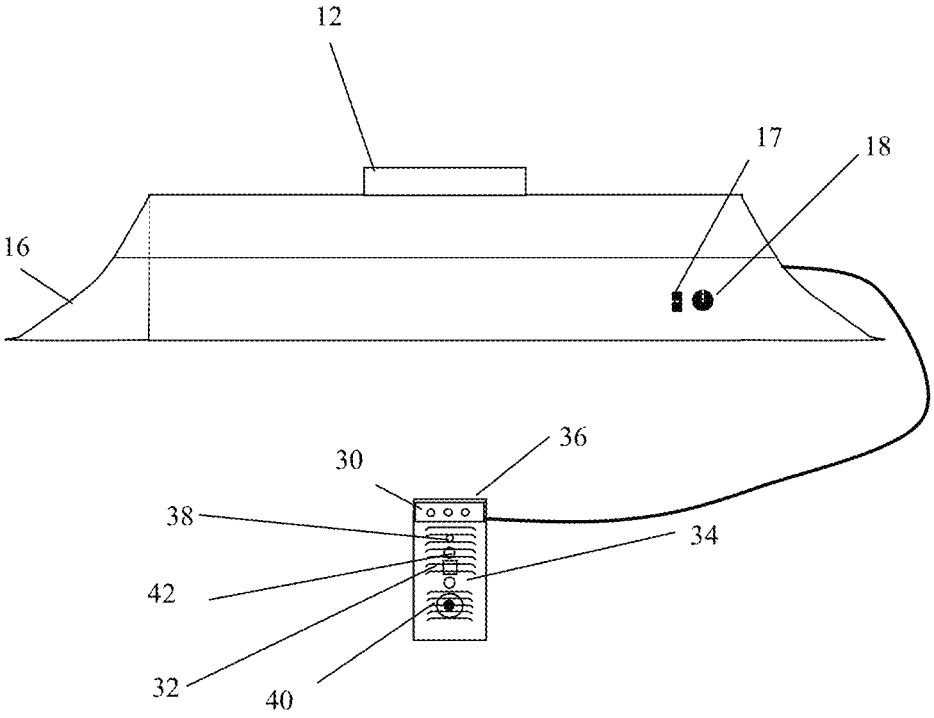
FIG. 3 is an alternative configuration showing an external control module that can be added to an existing hood installation.

FIG. 3 shows an embodiment where the controller is connected to an existing hood as an add-on accessory. The figure shows the hood enclosure 16, vent outlet 12, Auto/Manual switch 17 and manual speed control 18. Mounted below this hood and electrically connected in a manner which intercepts the circuit between the speed control and the fan is the accessory controller 36, including temperature sensor 38 (for example, thermistor, thermocouple, etc) and air quality sensor 42 (for example, smoke sensor, CO sensor, optical sensor, electro-chemical sensor, etc.), humidity sensor 32 (for example, capacitive, resistive, thermal conductive, etc.), and motion detector 34 (for example, IR, ultrasonic, etc.). Some type of user interface, such as LED indicators 30, shown here, can be provided. Other embodiments might include, incandescent lights, an alphanumeric, or graphical, or video display. This embodiment also includes an audible alarm 40 which could be a beeper, a buzzer, a siren, etc.

Figure 4:
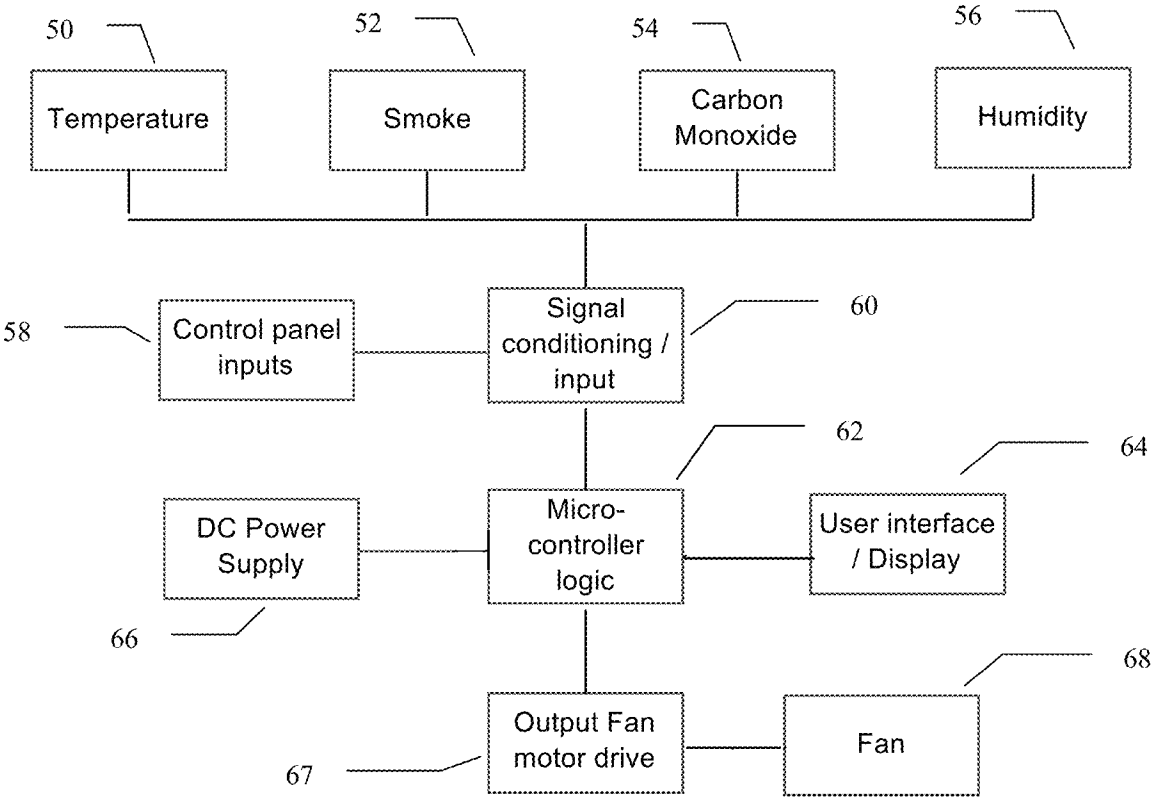
FIG. 4 is a functional block diagram of one embodiment of the hood control system.

FIG. 4 shows a functional block diagram of one embodiment of the hood control system. It depicts a variety of air quality sensors, such as temperature 50, smoke 52, carbon monoxide 54 and humidity 56. These provide input signals to the micro-controller logic IC 62, along with the control panel inputs 58, by way of the signal conditioning circuitry 60 which provides power to the sensor as well as any filtering that would be applied as standard practice in any signal input application. Power for the electronics is provided by a power supply 66 at the voltages appropriate for the devices being used. The power supply 66 of the current embodiment is generally DC, but other embodiments may use AC, battery supply, a combination of power supplies, etc. The micro-controller then acquires these input voltages, digitizes them, and using the embedded algorithms, generates outputs in the form of messages to be displayed on some form of user interface such as an LCD panel 64, as well as drive signals to be sent to a motor drive circuit 67 which provides the appropriate level and type of electrical power to the fan 68, such as, for example, pulse-width modulated (PWM) energy, be it AC or DC, sufficient to drive the fan 68 in a variable speed manner. Straight DC power can also be used, or AC power, speed controlled by a TRIAC or similar type of circuit.

Figure 5:
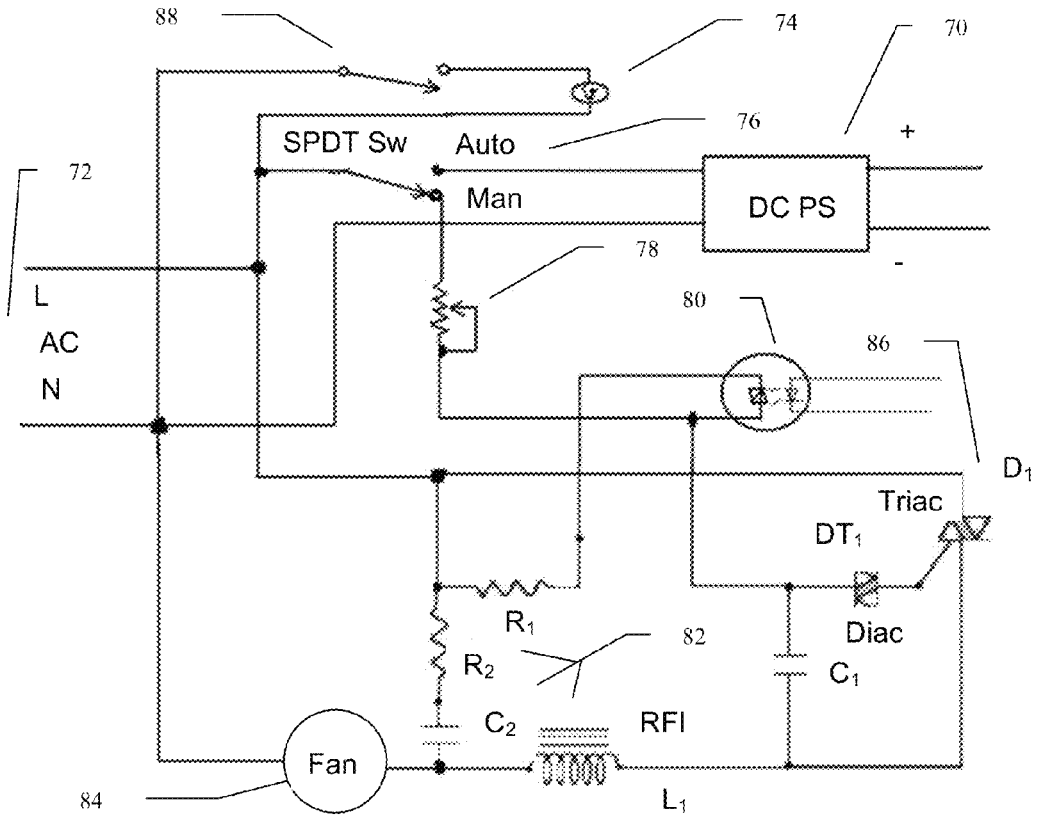
FIG. 5 is a schematic drawing of an example circuit.

FIG. 5 is a schematic of one embodiment of the AC circuit that provides the power for the smart range hood controller and the fan in the case where an AC fan is used. As the AC power enters the circuit at 72 it is routed to the lamp 74 through the lamp switch 88, and to the Auto/manual switch 76. In the manual mode, power flows through the manual speed control potentiometer 78 to the motor driver 80 and then to the fan 84 via the TRIAC elements 86 and the RFI filter network 82. In the Auto mode, it energizes the DC power supply 70, bypassing the manual speed control potentiometer 78. Instead of the potentiometer, a series of pulses or other control signals or voltages generated by the microprocessor will be fed to the motor driver, which will convert them and amplify them as needed, to a type and level that can be used to drive the fan. The rest of the circuit to the fan 84 is the same as in manual mode.

Figure 6:
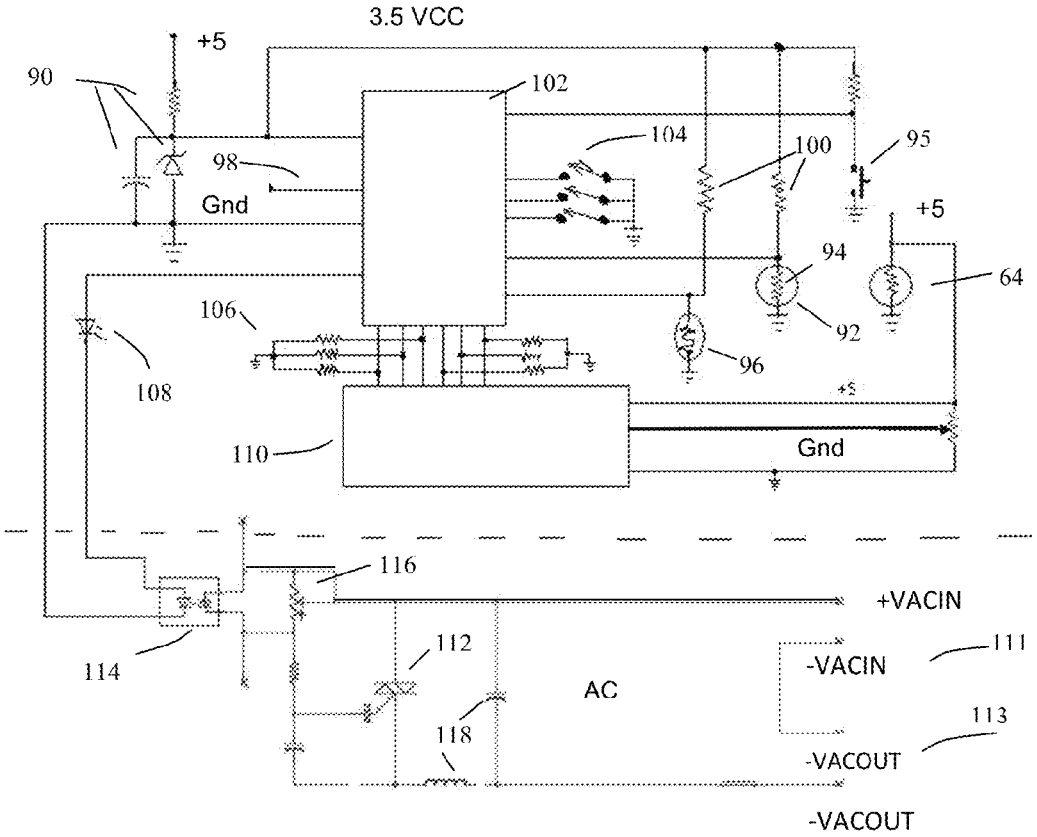
FIG. 6 is a schematic of the printed wiring board assembly that contains the microprocessor as well as the input-output portion of the controller.

Referring to FIG. 6, we see a more detailed schematic of one embodiment of a printed wiring board assembly (PWBA). The figure is divided by a dashed line. Above the line is the low-voltage DC portion of the circuit that handles the inputs, the data processing, and the user interface. Below the line is the AC line-voltage portion which handles the output to the fan. In this embodiment, the DC portion, a voltage control circuit 90 reduces the power supply voltage to the circuit operating voltage. A smoke/gas sensor 92, which could have an embedded heater 94, and temperature sensor 96 are connected to microprocessor 102 as analog inputs through pull-up resistors 100. An additional sensor (e.g. humidity) can be added on spare input line 98. The microprocessor 102 executes software code that responds to these inputs as directed by the setting of the DIP switch 104 which provides configuration option settings (e.g. gas or electric stove, sensitivity adjustment range, seasonal adjustment). Motor speed control signals are sent to the AC portion of the circuit through a diode 108 and an optical isolator 114. The current state of the system is communicated to the customer by means of signals directed through a driver resistor network 106 to a user interface 110 which could be a LCD or other visual display or audio device. A reset button 95 can be used to restart the software program in the event of a malfunction or if the customer wants to shut the fan off without waiting for the cycle to complete. In the AC portion of the circuit, in Auto mode, AC line voltage comes in at AC input 111 where it is modulated by control signals as it passes through a TRIAC device 112 to drive the AC output 113, which drives the fan subject to filter circuit 118. In manual mode the TRIAC 112 is controlled by a panel mounted potentiometer 116.

The software used to provide the intelligence to the hood operation can be represented as a main program and a series of subroutines, though it need not be structured that way in practice as long as the necessary functions are provided. The software combines aspects of both open-loop and closed-loop control, with timers making sure that once activated, the fan runs for at least a minimum amount of time, and sensors constantly monitoring the air quality to allow the system to respond to changes by moving into other operating modes as required.

The diagrams in this embodiment depict a smoke sensor, which in other embodiments could also be a gas sensor, capable of responding to various organic compounds including carbon monoxide, or a combination smoke/gas sensor. In all cases the software will respond in a similar manner. For simplicity's sake, there is no humidity sensor shown in this embodiment, but for embodiments that include a humidity sensor, the software may handle it in the same manner as the temperature sensor shown here.

The software essentially monitors the air quality sensors and controls the fan in response to them. In some embodiments, there are two different response modes, a level response, where the fan comes on in response to a level, which could be considered a guard band, being reached, and a differential response, where the fan is activated in response to a detected rate of increase in a parameter such as temperature or effluent. In both cases the fan is activated at a speed that is appropriate to the detected requirement. The levels are initialized at factory preset levels, though the system also has a learning capability where it self-adjusts guard band levels based on background conditions.

Figure 7:
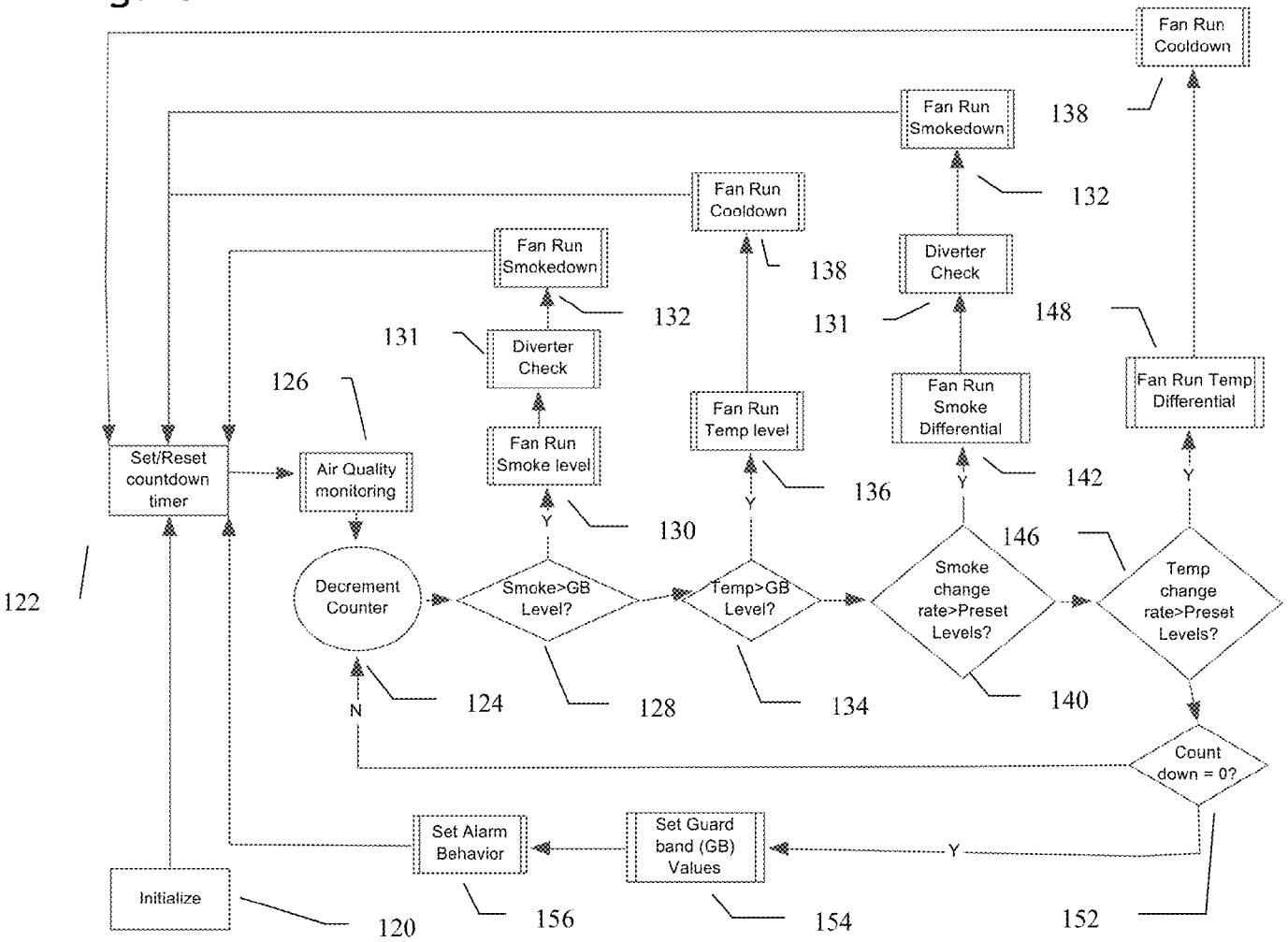
FIG. 7 is a flow chart of the main program which gives an overview of the software, including various subprograms.

FIG. 7 is a flow chart giving a functional overview of one embodiment of the software. The program begins at 120 at power up or after a reset when the microprocessor is initialized. A countdown timer 122 is set which establishes an execution loop. This is followed by the initiation of the "Air Quality Monitoring" routine 126. The routine proceeds through the loop, checking the sensors, and decrementing the counter at 124. If, at 128 the Smoke Level is measured to be above a preset trigger level, the Fan Run Smoke Level routine 130 will run, followed by the Diverter check 131 which can set the position of an exhaust damper for indoor or outdoor exhaust depending on the level of smoke contained in the exhaust stream. This is followed by Fan Run Smokedown routine 132, which contains the logic necessary to terminate fan operation. This routine, upon completion, brings the system back to the beginning where the countdown timer is reset 122 and where monitoring 126 can resume. Likewise, if the measured temperature exceeds one of the preset, or self-adjusted, temperature thresholds 134, the routine will branch to the Fan Run Temp Level 136 followed by the Fan Run Cooldown 138. Each of these routines is described in a separate flow chart. If neither temperature nor smoke levels are detected, the program flow continues to the check smoke rise rate step at 140. This requires checking both a level and an elapsed time as will be described later. If the smoke rise rate exceeds a predetermined threshold, which could be affected by the position of the front panel smoke sensitivity control 15, if used, the routine Fan Run Smoke Differential 142 is executed, followed by the Diverter check 131 which can set the position of an exhaust damper for indoor or outdoor exhaust depending on the level of smoke contained in the exhaust stream. Upon completion it passes control to the Fan Run Smokedown routine 132 as described earlier. If the smoke rise rate is insufficient to trigger a response, the routine moves on to compare the temperature rise rate to a predetermined level 146 which could be affected by the position of the front panel temperature sensitivity control 13, if used. If a sufficient rise rate is detected at 146, Fan Run Temp Differential 148 is activated, which passes control on to Fan Run Cooldown 138 upon completion. If neither rates nor levels are exceeded, the program checks the countdown value 152. If it has not yet run down to zero, it returns to 124. If it has, then control returns to the beginning of the loop at 122 to be repeated. But before repeating the loop it checks the long term rate of change of the sensor values relative to determine if the guard band levels 154 need to be adjusted. It also checks to see if there is a person present in front of the hood so that it can adjust the volume of an audible alarm 156 accordingly. The next nine flow charts describe embodiments of the individual routines in detail.

Figure 8:
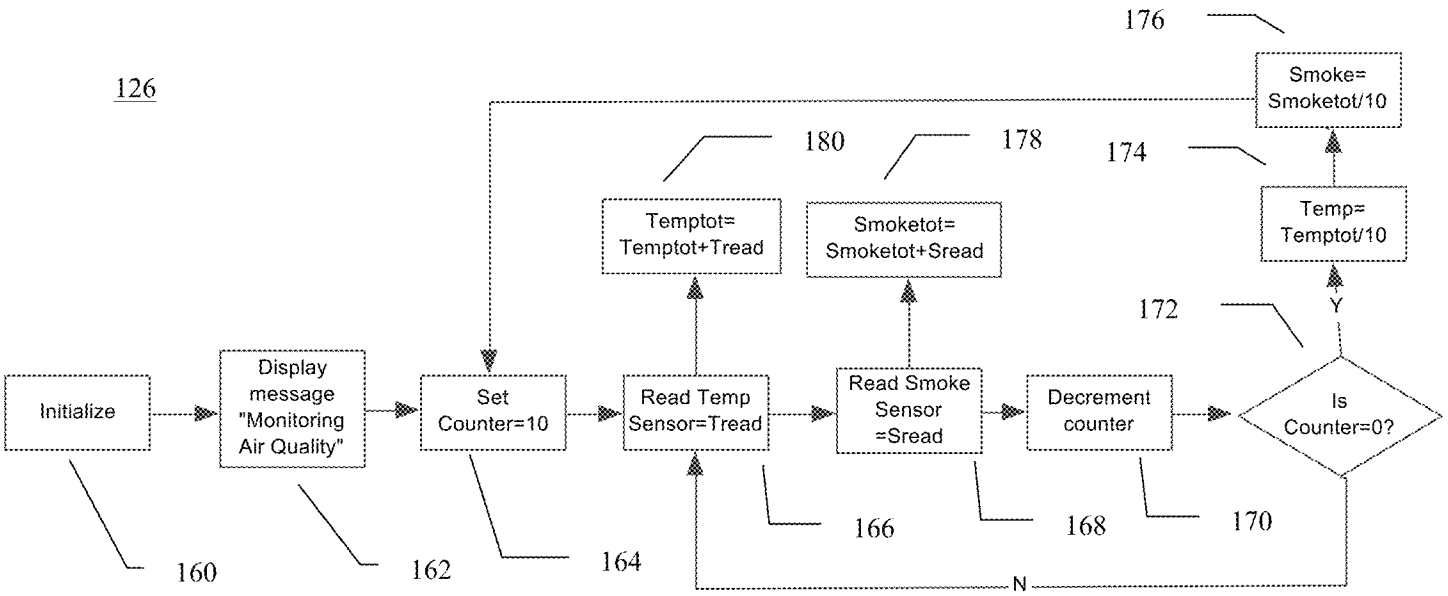
FIG. 8 is a flow chart of the Air quality monitoring subprogram, which describes the "ready" mode.

FIG. 8 is a flowchart of one embodiment of the Air Quality Monitoring routine 126. The routine reads the sensors and creates a moving average of each sensor output to provide stability to the software. The routine initializes at 160 and sends a message to the User Interface (UI) display indicating "Monitoring Air Quality" 162. It sets a loop counter at 164 and reads the temperature sensor at 166 and the smoke sensor at 168. It accumulates temperature and smoke readings at 180 and 178 respectively, then decrements the loop counter at 170. At 172 it checks to see if the count has been completed. If it has, it divides the accumulated totals by the number of counts and passes the values for Temperature 174 and Smoke 176 back to the main program, before starting a new loop at 164. If it hasn't it goes back into the loop and repeats.

Figure 9:
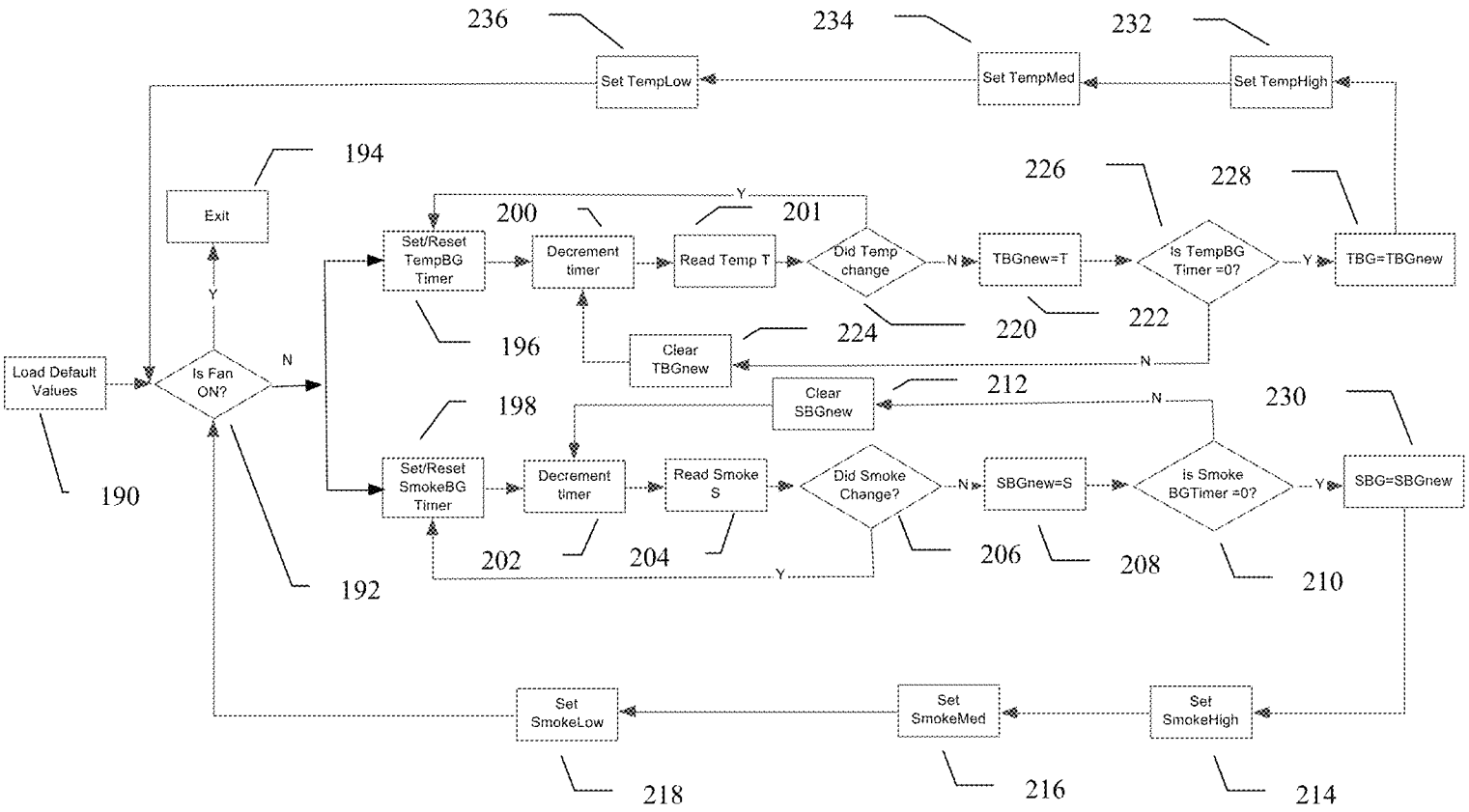
FIG. 9 is a flow chart of the Set Guard Band Level subprogram which determines the trigger levels for each of the air quality sensors based on the background conditions.

FIG. 9 is one embodiment of a routine that sets the guard band levels 154, in this case for smoke and temperature. The guard bands are used as upper limits for temperature, smoke, etc., in case the rates rise too slowly to be detected by the differential routines. This takes place during idle periods when the fan is not running. If sufficient time has elapsed during which the sensor readings are stable, these become the new background levels, from which the new guard band levels are calculated. The guard band levels are only updated under the conditions that: a) the fan is not currently running, and b) the sensor levels have not changed more than a small incremental value over the prescribed sampling interval which could be on the order of 30 minutes, for example. The routine starts by loading the factory default values 190. Then it checks to see if the fan is running 192. If the fan is running, then the routine exits 194. If not, the routine goes through an evaluation of each sensor. individually. Looking at smoke first, the routine sets a smoke background timer 198. Then it decrements the timer 202 and reads the smoke level 204. If the smoke level changed 206, it goes back to the beginning of the loop 198. If the smoke level did not change more than the allotted increment, it sets a new temporary background smoke level 208. It then checks 210 to see if the smoke background timer has elapsed. If it has, which means that the smoke has remained unchanged for the prescribed duration of time, then it established a new background smoke level 230. Based on this new background level, it establishes new High 214, Medium 216 and Low 218 smoke guard band levels before returning to the beginning of the loop at 192.

The temperature guard band is set in exactly the same way. For convenience, it is shown as a parallel operation here, but given the processing speed available today it could very well be done sequentially.

The routine sets a temperature background timer 196. Then it decrements the timer 200 and reads the temperature level 201. If the temperature level changed 220, it goes back to the beginning of the loop 196. If the temperature level did not change, then, it sets a new temporary background temperature level 222. Note that not changing means that it changed less than a small prescribed increment. It then checks 226 to see if the temperature background timer has elapsed. If it has, which means that the temperature has remained unchanged for the prescribed duration of time, then it established a new background temperature level 228 Based on this new background level, it establishes new High 232, Medium 234 and Low 236 temperature guard band levels before returning to the beginning of the loop at 192.

Figure 10:
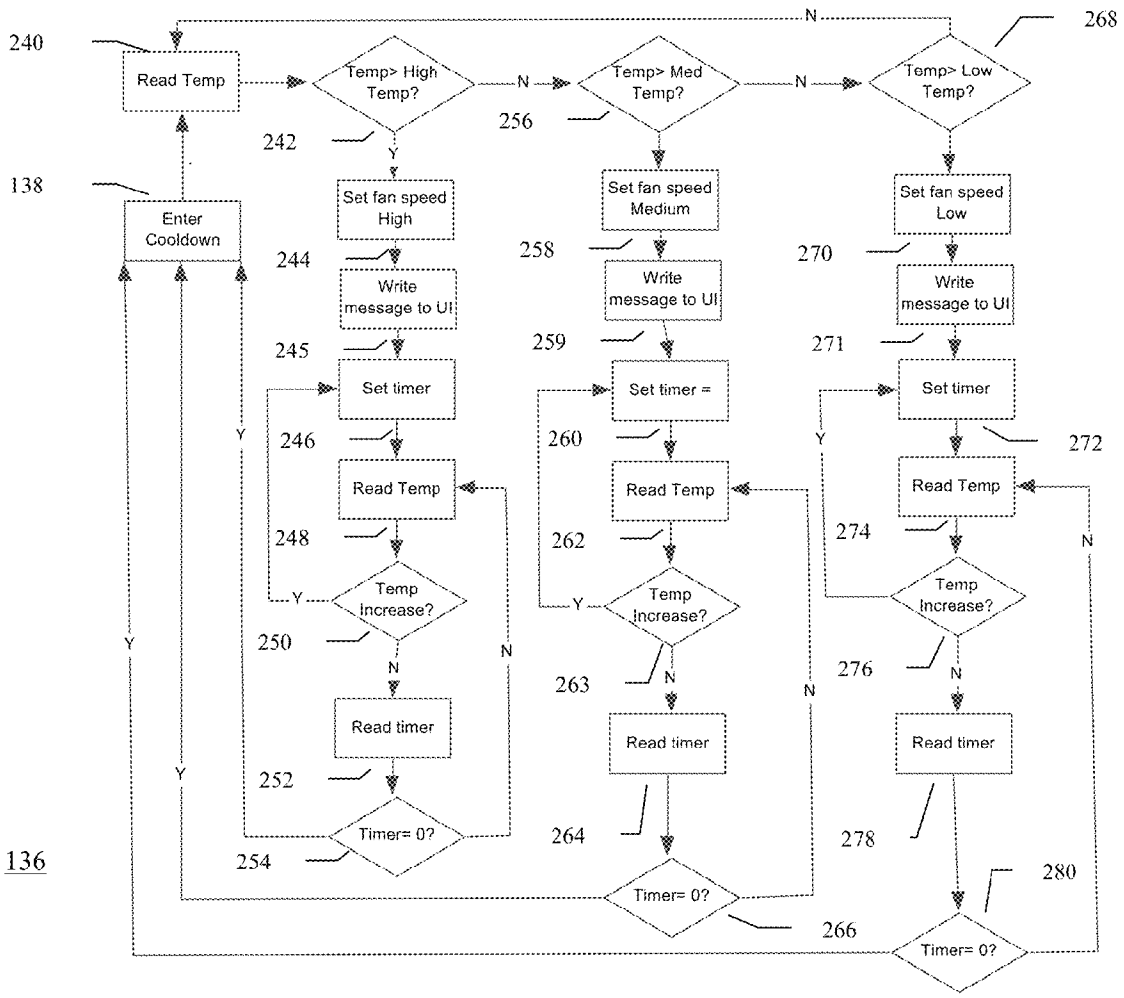
FIG. 10 is a flow chart of the Temperature Run Level subprogram which controls fan operation when the temperature reaches one of the guard band levels.

FIG. 10 shows a flow chart for one embodiment of the Fan Run Temperature Level 136 routine. The routine controls the fan in the case where the guard band levels have been reached. At 240 the routine takes a temperature reading per the monitoring air quality routine described above (FIG. 8). It checks to see if the High guard band has been reached at 242. If yes, then it turns on the fan to High speed 244 and writes a message to the UI 245 (if present) indicating that a High temperature level has been detected. Then the routine enters a loop where it checks to see that the fan is maintaining temperature. A timer is set 246, and the temperature is read 248. A check is made 250 to see if the temperature is increasing. If it is, the timer is reset 246, ensuring that the fan will continue running. Otherwise it exits the loop and the timer continues to run. The timer is then read, 252. If it has not fully elapsed 254 it goes back into the loop at 248. If the timer has elapsed, it enters the Cooldown cycle 255, before returning to 240 which is essentially the monitoring mode.

If the temperature is not High 242, the routine next checks to see if the Medium guard band has been reached at 256. If yes, then it turns on the fan to Medium speed 258 and writes a message to the UI 259 (if present) indicating that a Medium temperature level has been detected. Then the routine enters a loop where it checks to see that the fan is maintaining temperature. A timer is set 260, and the temperature is read 262. A check is made 263 to see if the temperature is increasing. If it is, the timer is reset 260, ensuring that the fan will continue running. Otherwise it exits the loop and the timer continues to run. The timer is then read, 264. If it has not fully elapsed 266 it goes back into the loop at 262. If the timer has elapsed, it enters the Cooldown cycle 138, before returning to 240.

If the temperature is not Medium 256, the routine next checks to see if the Low guard band has been reached at 268. If yes, then it turns on the fan to Low speed 270 and writes a message to the UI 271 (if present) indicating that a Low temperature level has been detected. Then the routine enters a loop where it checks to see that the fan is maintaining temperature. A timer is set 272, and the temperature is read 274. A check is made 276 to see if the temperature is increasing. If it is, the timer is reset 272, ensuring that the fan will continue running. Otherwise it exits the loop and the timer continues to run. The timer is then read, 278. If it has not fully elapsed 280 it goes back into the loop at 274. If the timer has elapsed, it enters the Cooldown cycle 138, before returning to 240. If the temperature did not exceeds the Low guard band at 268, the program flow returns to 240 to repeat the whole process again.

Figure 11:
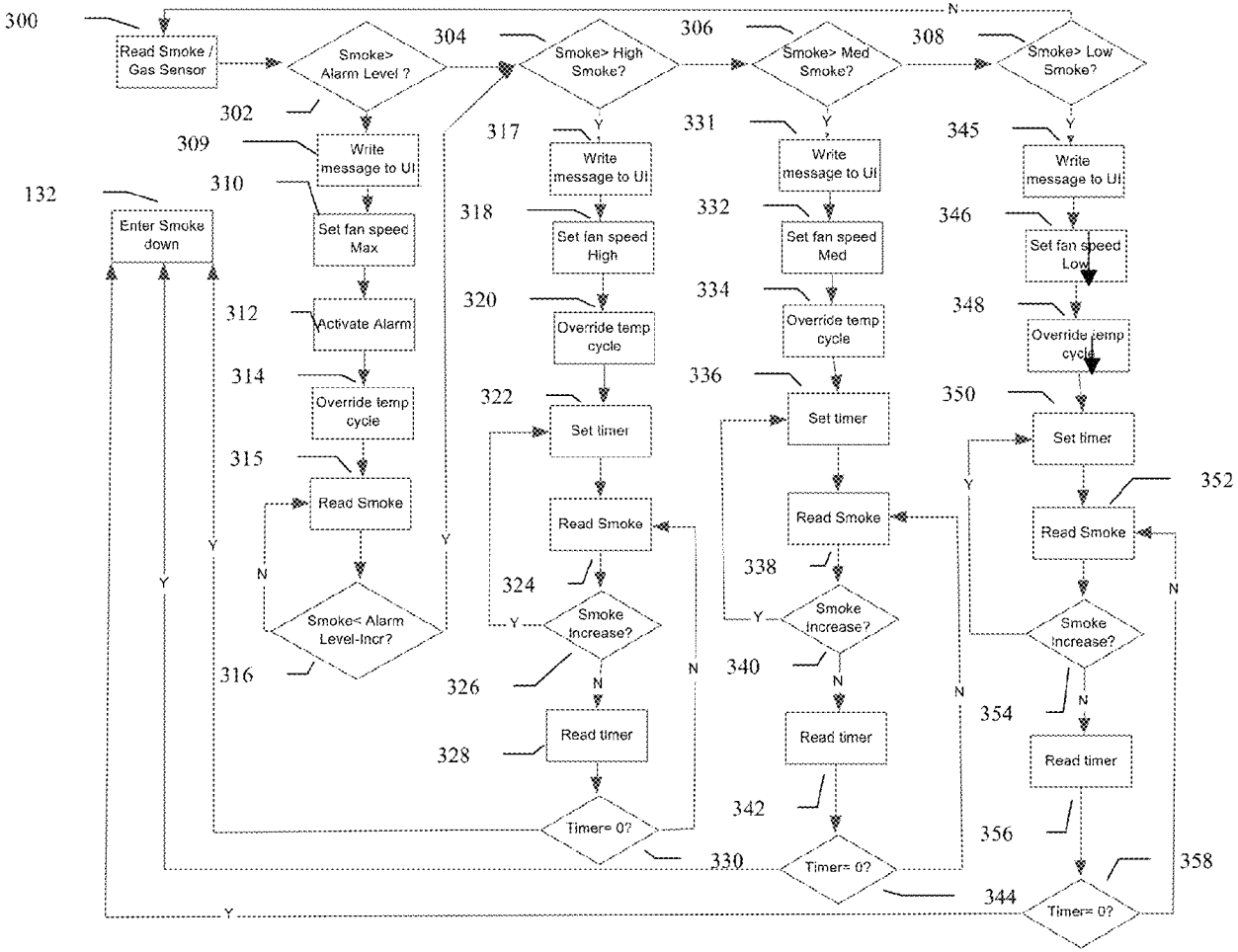
FIG. 11 is a flow chart of the Smoke Run Level subprogram which controls fan operation when the smoke level reaches one of the guard band levels.
Figure 16:
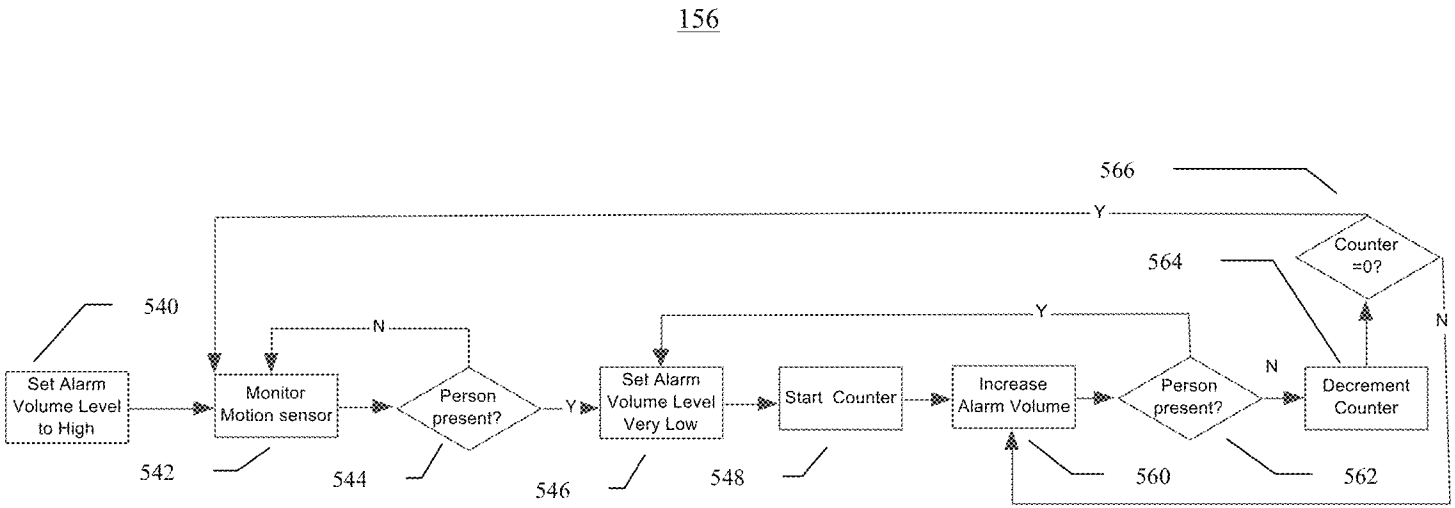
FIG. 16 is a flow chart of the Alarm Behavior subprogram that controls the interaction of the motion sensor and the audible smoke alarm feature included in some embodiments.

FIG. 11 shows a flow chart for one embodiment of the Fan Run Smoke Level 130 routine. The routine controls the fan and the alarm in the case where the guard band levels have been reached. At 300 the routine takes a smoke level reading per the monitoring air quality routine described above (FIG. 8). It first checks to see if the smoke alarm level 302 has been reached. If yes, it writes a message to the UI (if present) indicating that a hazardous smoke level has been detected 309, sets the fan speed to maximum 310, and activates the audible alarm 312 at the volume level determined by the Alarm Behavior subroutine (FIG. 16). It then overrides the temperature cycle 314, reads the smoke level 315 and rechecks to see if the smoke level is decreasing 316. If it is, it exits the routine. If not, it continues running the fan and the alarm, looping back to read the smoke level 315 until a decrease is detected. If the smoke is not at the alarm level 302, control passes to 304 where the routine then checks to see if the High guard band level has been reached. If yes, then it writes a message to the UI 317 indicating that a High smoke level has been detected and turns on the fan to High speed 318. It then overrides the temperature cycle 320. Then the routine enters a loop where it checks to see that the fan is maintaining smoke level. A timer is set 322, and the smoke level is read 324. A check is made 326 to see if the smoke level is increasing. If it is, the timer is reset 322, ensuring that the fan will continue running. Otherwise it exits the loop and the timer is read 328. The fan continues to run at High speed until the timer elapses. If it has not fully elapsed 330 it goes back into the loop at 324. If the timer has elapsed, it enters the Smokedown cycle 132. If the smoke level is not High 304, the routine next checks to see if the Medium guard band has been reached at 306. If yes, then it writes a message to the UI 331 indicating that a Medium smoke level has been detected and turns on the fan to Medium speed 332. It then overrides the temperature cycle 334. Then the routine enters a loop where it checks to see that the fan is maintaining smoke level. A timer is set 336, and the smoke level is read 338. A check is made 340 to see if the smoke level is increasing. If it is, the timer is reset 336, ensuring that the fan will continue running. Otherwise it exits the loop and the timer is read 342. The fan continues to run until the timer elapses. If it has not fully elapsed 344 it goes back into the loop at 338. If the timer has elapsed, it enters the Smokedown cycle 132. If the smoke level is not Medium 306, the routine next checks to see if the Low guard band has been reached at 308. If yes, then it writes a message to the UI 345 (if present) indicating that a Low smoke level has been detected and turns on the fan to Low speed 346. It then overrides the temperature cycle 348. Then the routine enters a loop where it checks to see that the system is maintaining smoke level. A timer is set 350, and the smoke level is read 352. A check is made 354 to see if the smoke level is increasing. If it is, the timer is reset 350, ensuring that the fan will continue running. Otherwise it exits the loop and the timer continues to run. The timer is then read, 356. If it has not fully elapsed 358 it goes back into the loop at 352. If the timer has elapsed, it enters the Smokedown cycle 132. If the smoke level did not exceeds the Low guard band at 308, the program flow returns to 300 to repeat the whole process again.

Figure 12:
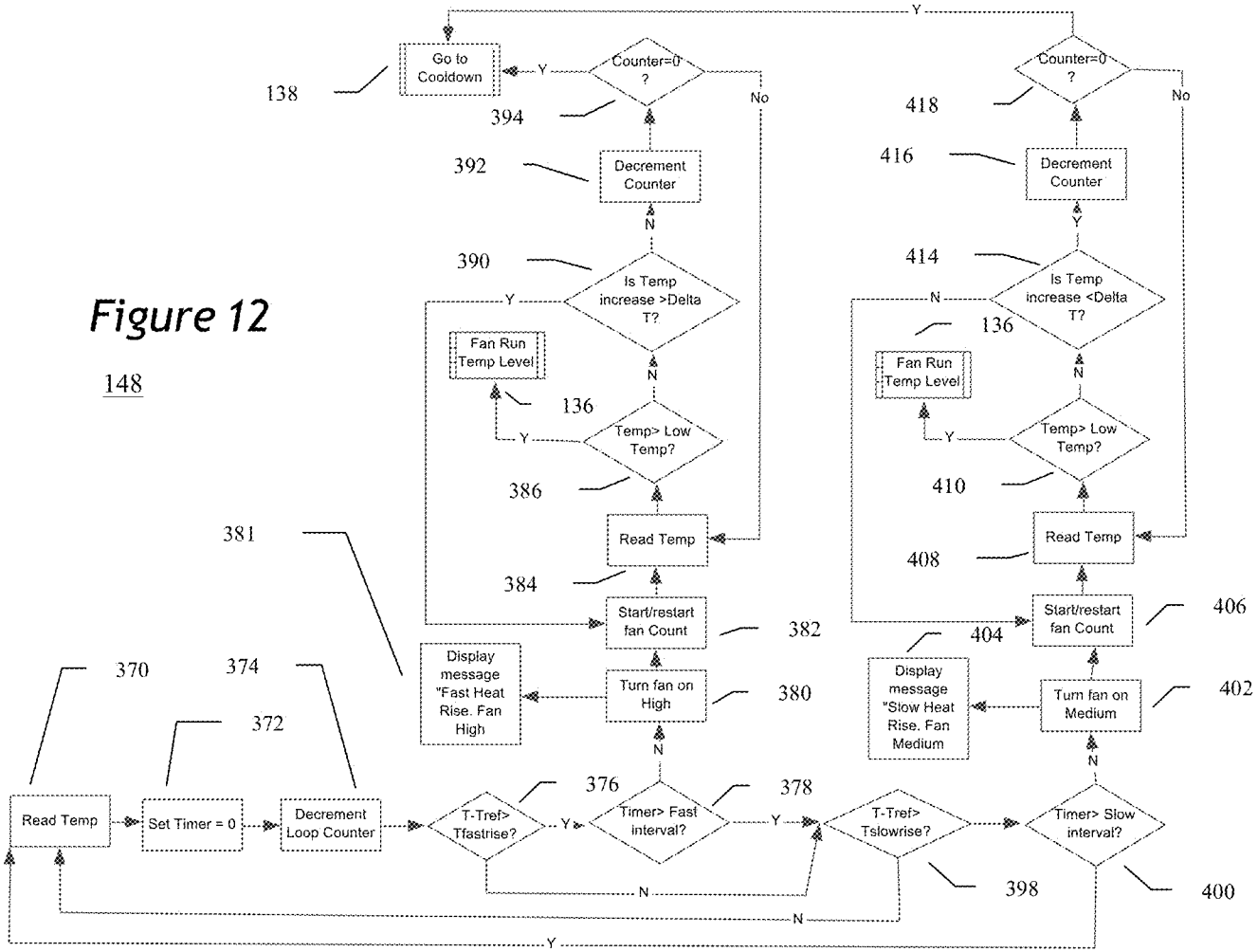
FIG. 12 is a flow chart of the Temp Differential subprogram which controls fan operation when the temperature rise rate reaches one of the preset thresholds.

FIG. 12 is a flow chart that describes the operation of one embodiment of the Fan Run Temperature Differential routine 148. This routine, designed for rapid response, controls the fan operation within the temperature guard band levels, in response to detected rates of temperature change. A temperature rate of change corresponds directly to a heat level being given off by the stove, so that the fan speed is set accordingly. Temperature rate detection is an excellent way to quickly detect the onset of cooking.

By looking at the rate of increase rather than a fixed level, this approach greatly reduces the number of false positives. At the same time the guard bands, which are derived from and differentiated from the background conditions, will back up the rate detection scheme in cases where there are gradually increasing changes in temperature that ultimately reach guard band levels.

This rate-detection algorithm could be expanded to incorporate any number of discrete differential intervals (e.g. slow rise, medium rise, fast rise, very fast rise, etc.) with corresponding fan speeds, but for purposes of illustration, two (fast and slow) are included here.

The routine runs in a loop that begins by reading the temperature 370 setting a timer 372 and decrementing the loop counter 374. The temperature value is checked to see if it has increased enough to constitute a fast rise 376. If not, it jumps ahead to see is the temperature increase is enough to constitute a slow rise 398. If the temperature increase is enough to qualify for a fast rise, the timer is then checked 378, to see how much time has elapsed. If the fast rise interval has already passed, then the routine moves along to 398 to check for slow rise temperature. If the fast rise interval had not elapsed, then the fast rise routine is initiated at 380 by turning the fan on High. A message is also displayed on the UI at 381 saying something along the lines of "Fast Temperature Rise Detected. Fan Speed High." Another counter 382 is started for this routine which will determine how long the fan will stay on. The temperature is read at 384 and checked at 386 to see if it exceeds the Low Temp level. If it does, the routine goes to the Fan Run Temperature Level 136 routine described earlier. If it doesn't, it is checked again at 390 to see if the rise is greater than the prescribed interval DeltaT. If it is, the routine goes back into the loop, keeping the fan running, decrementing the counter at 382. If not, it continues to decrement the counter 392. The counter value is checked at 394. If it has elapsed, control is then passed to the CoolDown routine 396 which will bring the fan speed gradually down to zero. If it hasn't elapsed yet, it goes back into the loop with the fan still running at 384 where the temperature is checked again.

If the temperature at 398 was less than the Slow rise temperature control returns to the beginning of the loop at 370. If the temperature exceeds that threshold the routine goes on to check the elapsed time interval at 400. If the slow rise time interval has already elapsed, control returns to the start 370 which is, in essence, returning to the Main program. On the other hand, if the Slow rise counter has not yet elapsed 400, the routine enters the Slow differential routine at 402 by turning the fan on at Medium speed. A message is also displayed at on the UI at 404 saying something along the lines of "Slow Temperature Rise Detected. Fan Speed Medium." Another counter 406 is started for this routine which will determine how long the fan will stay on. The temperature is read at 408 and checked at 410 to see if it exceeds the Low Temp level. If it does, the routine goes to the Fan Run Temperature Level 136 routine described earlier. If it doesn't, it is checked again at 414 to see if the rise is greater than the prescribed interval DeltaT. If it is, the routine goes back into the loop, decrementing the counter at 406. If not, it continues to decrement the counter 416. The counter value is checked at 418. If it has elapsed, control is then passed to the CoolDown routine 396. If it hasn't elapsed yet, it goes back into the loop with the fan still running at 408 where the temperature is checked again.

Figure 13:
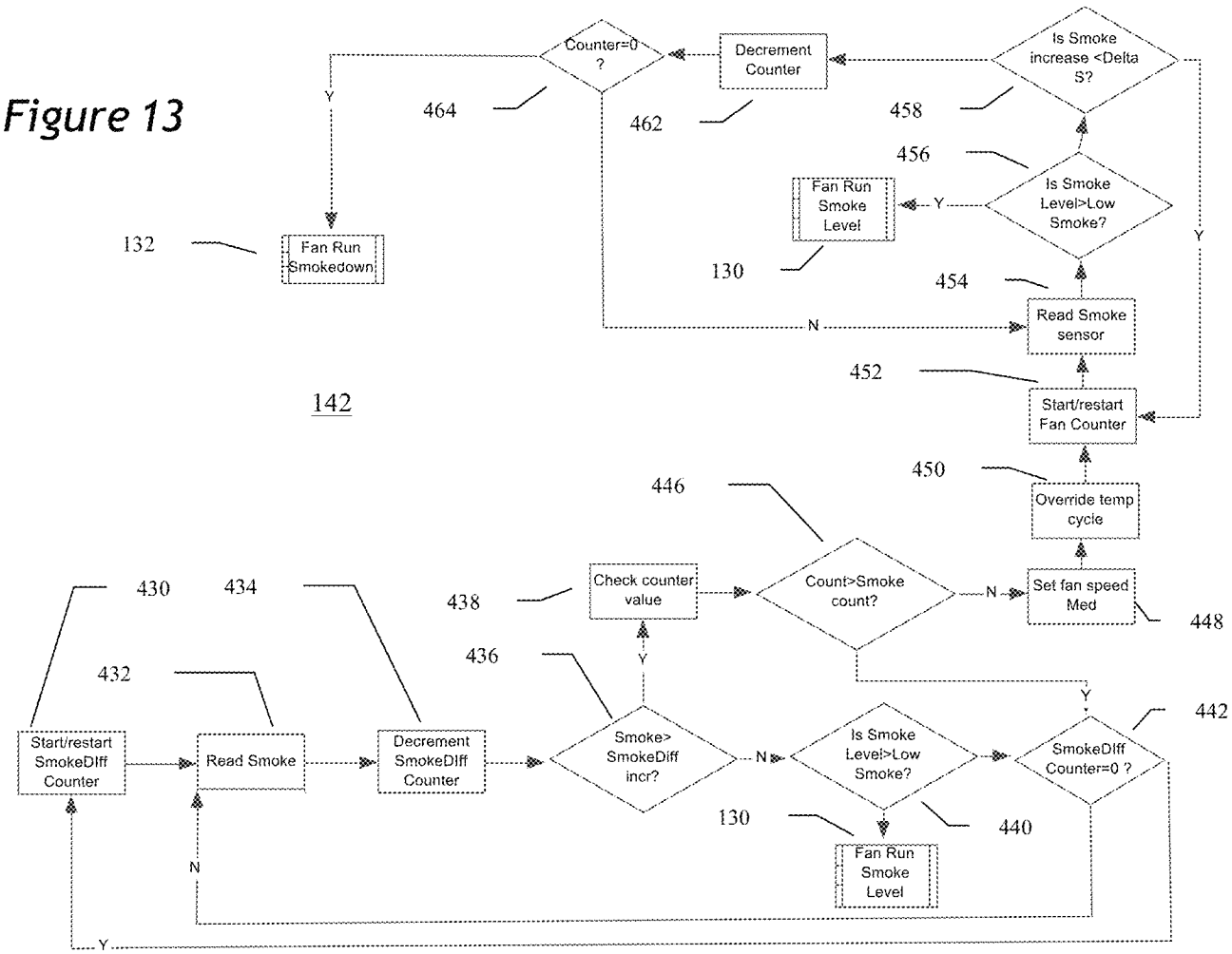
FIG. 13 is a flow chart of the Smoke Differential subprogram which controls fan operation when the smoke rise rate reaches one of the preset thresholds.

FIG. 13 is a flow chart that describes the operation of one embodiment of the Fan Run Smoke Differential routine 142. This routine, designed for rapid response, controls the fan operation within the Smoke guard band levels, in response to detected rates of Smoke level change. The operation is quite similar to the Temperature Differential routine described above (FIG. 12), although in this case, although any number of discrete differential rates could be used with corresponding fan speeds, only one differential level is shown. The first loop begins by starting a smoke differential counter 430 and then reading the smoke level 432 before decrementing the counter 434. At 436 it checks to see if the smoke level has increased beyond a predetermined increment. If not, it loops back for another smoke level reading 432, but not before checking 440 to see if the smoke has exceeded the Low Smoke (guard band) level. If yes, it calls the Fan Run Smoke Level routine 130. If, at 436, the smoke has exceeded the smoke differential increment, it checks the counter value at 438 to see if the second condition has been met for a rate of change sufficient to warrant a response. If the counter value exceeds the predetermined interval 446 it reenters the loop, checking at 442, if the loop counter has elapsed. If yes, it returns to 430 to start a new loop, otherwise it continues the existing loop at 432. On the other hand, if the count at 446 was within the predetermined interval, meaning that the rate of increase was of concern, fan operation is initiated 448 at a Medium speed. This overrides the temperature cycles by priority 450, and starts a fan run counter 452 to determine how long, in an open loop manner the fan will stay on. The smoke sensor is then read 454 to supplement the open loop control with a closed loop component. First, the smoke level is checked to see if it exceeds the Low smoke level threshold 456. If yes, then control is passed to the Fan Run Smoke Level routine 130 described earlier. If not, the smoke increase is then compared with a preset increment delta S 458 to see if the smoke level is increasing significantly. If it is, control is passed back into the loop at 452, which resets the counter, keeping the fan running for another cycle. If the smoke level is not increasing, the counter is decremented 462 reducing the remaining run time. If the counter has fully elapsed 464, control is passed to the Smokedown routine 132. Otherwise it returns into the loop to read the smoke sensor again 454.

Figure 14:
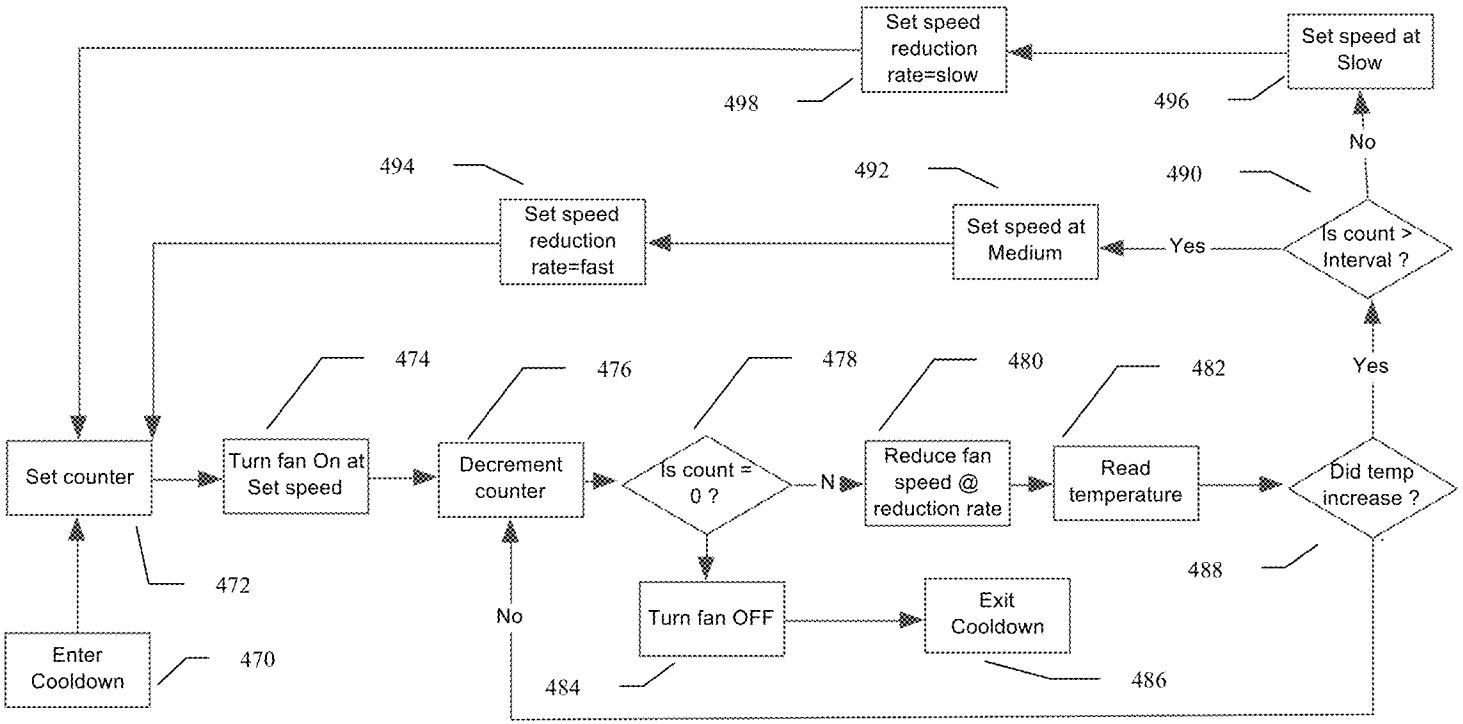
FIG. 14 is a flow chart of the Cooldown subprogram which controls the fan ramp down procedure as the heat in the system begins to decrease.

FIG. 14 describes the CoolDown Cycle 138 which is called after a Fan Run Temperature Level 136 or Fan Run Temperature Differential cycle 148 has completed. This means that the fan has been running for some minimum period of time. The reason for this cycle is that with the fan running, it is difficult to tell what is happening on the stove below, since the ventilation tends to drive the detected temperature or contaminant level down to the ambient level. At this point there is a substantial loss of sensitivity to any rate of effluent emission that is less than the amount being evacuated. If, in order to improve sensitivity, the fan is turned off to resample the air, and then immediately turned back on again when heat or effluents are present, this could result in unstable or jerky operation that could prove objectionable to the user, particularly from a noise standpoint. The Cooldown routine seeks to balance the amount of air being exhausted with the amount of heat being generated by gradually reducing fan speed when continuously checking the temperature to make sure that the heat is off and the temperature is decreasing. Decreasing fan speed, essentially increases the sensitivity of the system. If it senses a temperature rise rate or level sufficient to trigger one of the routines described earlier, it will return to the appropriate cycle. If there is no change in temperature, the Cooldown will continue to cycle and run the fan at low speed, incrementally reducing the speed until, seeing no further temperature rise, finally shuts the fan off. This indicates that the system has returned to equilibrium and is returned to the standby/sampling air quality mode.

The cycle initializes at 470 then sets a loop counter 472 and setting the fan to a preset speed 474, which is generally close to the speed at which it initially enters. It then enters the inner countdown loop 476 by decrementing the counter. It checks 478 to see if the counter is exhausted. If it is, the fan is shut off 484 and the routine is exited 486. If not, the loop continues by decreasing the fan speed at a preset reduction increment 480. In this embodiment there are two reduction rates that are used: Fast and Slow. The cycle begins with the Fast reduction rate by default which utilizes a larger speed reduction increment. At this point the temperature is read 482 and then checked 488 to see if there was an increase. If there was no increase, control passes back to the beginning of the loop, decrementing the counter 476 thereby reducing the remaining run time. If the temperature did show an increase, control passes to 490 where the elapsed count is checked. In either case, control will return to the initial outer loop entry point 472, which resets the fan run time counter, keeping the fan running. If it was early in the count (e.g. less than halfway) that indicates that the temperature rise came quickly. Therefore the fan speed is set, in this case to medium 492 and the reduction rate set at fast 494. In this way the controller is searching for the fan speed that balances the amount of heat being exhausted through the fan vent with the amount being produced by the stove. This path could be considered a search of coarse granularity. On the other hand, if the temperature rise had been detected later in the count (e.g. gone past halfway in this embodiment), that means the temperature was rising more slowly, the controller moves to the path of finer granularity, where the speed is set to Low 496 and the reduction rate is set to Slow 498. The speeds and rates described above should be considered exemplary for this one particular embodiment, though it should be understood that other speeds and rates could also be used.

Figure 15:
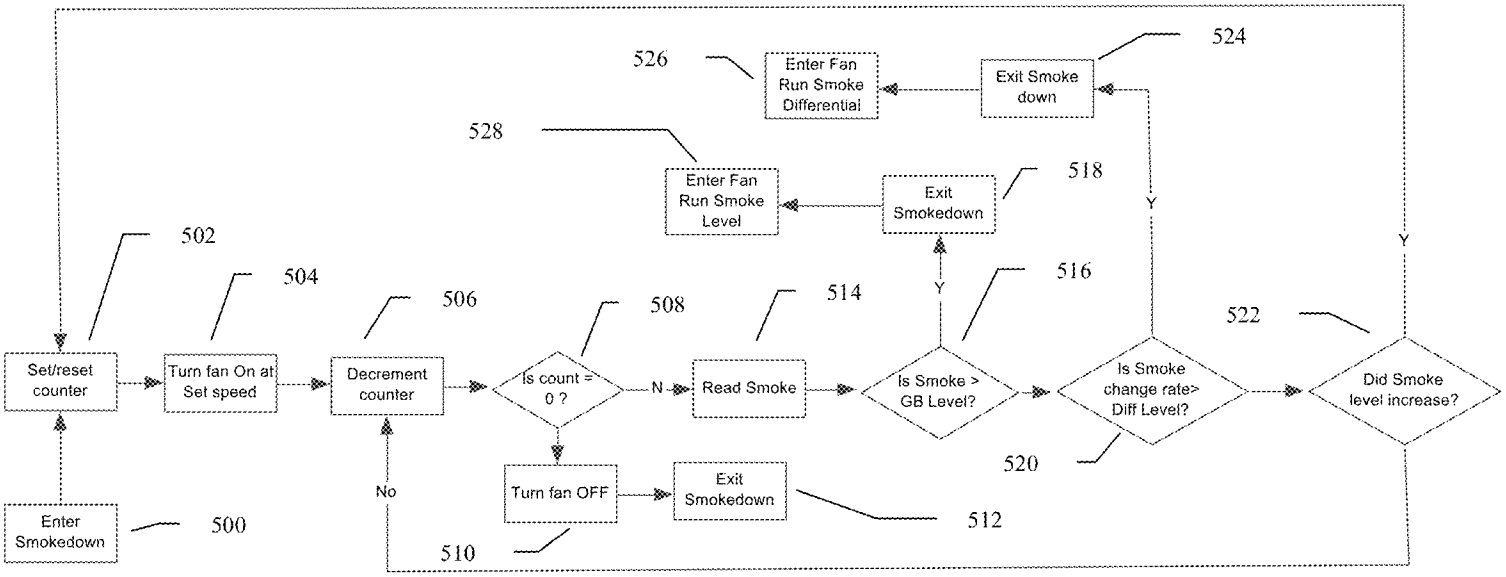
FIG. 15 is a flow chart of the Smokedown subprogram which controls the fan ramp down procedure fan as the smoke level in the system begins to decrease.

FIG. 15 refers to one embodiment of the SmokeDown cycle 132 which serves a similar function to the CoolDown 138, except that it is utilized in the case where the system had been responding to smoke or gas. It is called after a Smoke Level 130 or Smoke Differential 142 cycle has completed, which means the fan is still running. It gradually reduces fan speed when continuously checking the smoke level to make sure that the heat is off and the smoke level is decreasing. If it senses a smoke level rise or preset level, it will return to the appropriate cycle. If there is no change in smoke level, the Smokedown will continue to cycle and run the fan at low speed until it sees no further smoke level rise. This indicates that the system has returned to equilibrium and the fan is then shut off. The cycle initializes at 500 then sets a loop counter 502 and setting the fan to a preset speed 504, which is generally close to the speed it initially enters at. It then enters the inner countdown loop by decrementing the counter 506. It checks 508 to see if the counter is exhausted. If it is, the fan is shut off 510 and the routine is exited 512. If not, the smoke level is read 514. If the smoke level is greater than the guard band level 516, the controller exits Smokedown 518 and moves into Run Smoke Level 528 that was described previously (FIG. 11). If the level did not exceed the guardband level 516, the rate is then checked to see if the Differential Rate Level is exceeded 520. If yes, controller exits Smokedown 524 and moves into Run Smoke Differential 142 that was described previously (FIG. 13). If the rate did not increase, the level is then checked to see if it increased at all 522. If not, the counter is decremented 506 and the loop repeated until the counter runs down 508 and the fan turns off 510. If the smoke level did increase at 522, control returns to 502 to start a new cycle and keep the fan running.

FIG. 16 describes one embodiment of the Set Smart Alarm Behavior routine 156. This routine, adjusts the volume of the audible alarm depending on how recently the motion detector was activated. The idea behind this is that if a person is nearby the alarm does not need to be very loud. This is intended to avoid having this safety feature becoming an annoyance. Upon initialization, the alarm volume is set to High 540. The motion sensor is monitored 542 in a continuous loop which is exited if the presence of a person is detected 544. Once a person is detected the alarm volume level is set to Low 546. At that point an interval counter is set 548. At each interval, the volume is increased 560. If a person is detected 562 control returns to 546 where the volume is reduced and the counter is restarted 548. Otherwise, the counter is decremented 564. If the counter has fully elapsed 566, with sufficient counts to have brought the volume back to the High level, control returns to the beginning of the sequence 540. Otherwise, the routine returns to 560 where the alarm volume is increased.

Figure 17:
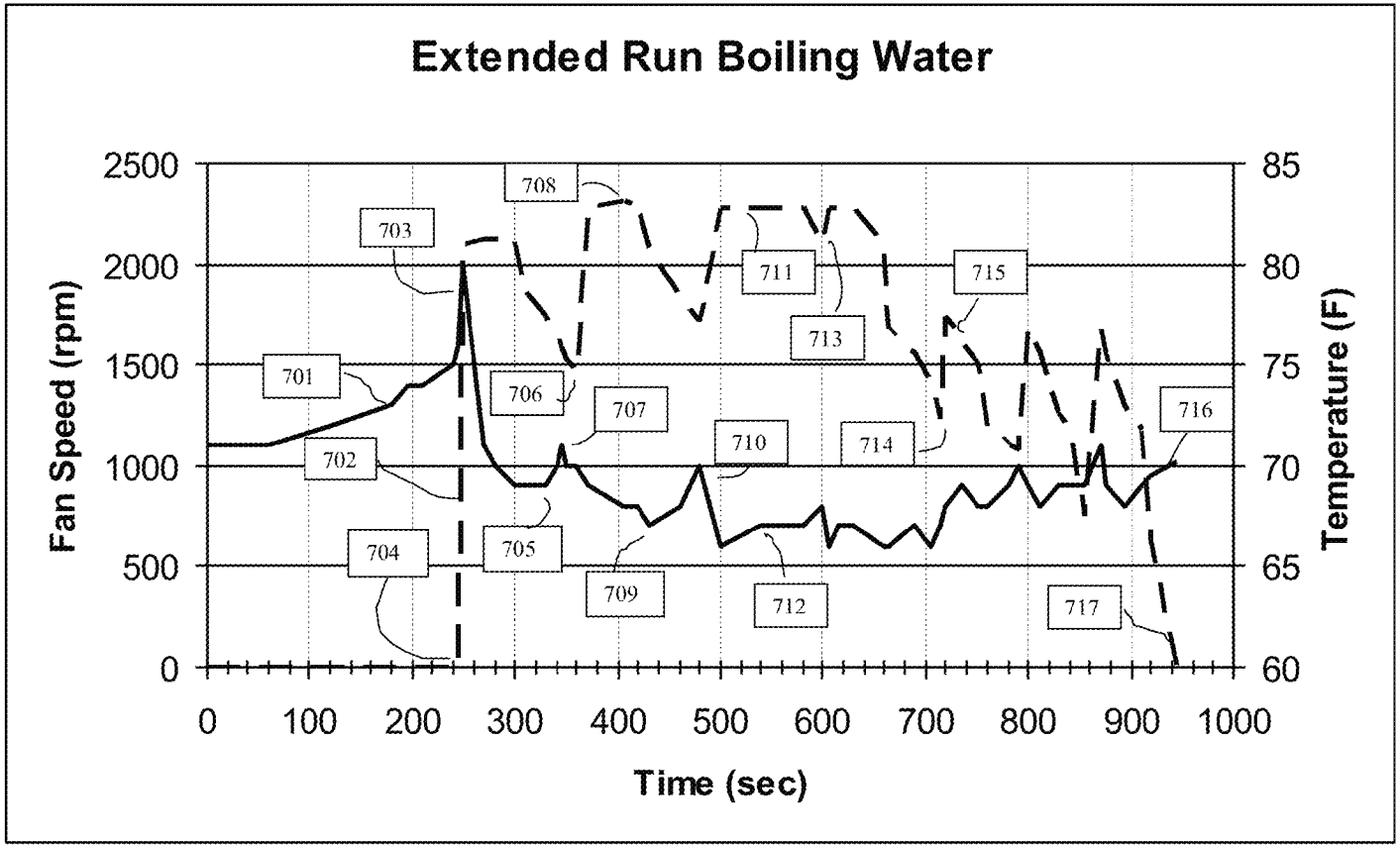
FIG. 17 is a time history chart showing one embodiment of the control system's response to a boiling water operation.

FIG. 17 shows the actual performance of one embodiment of the range hood controller in a test run of about 15 minutes in duration where water was boiled in a pot on the stove beneath the hood. There are two variables being plotted as a function of time; 701 shows the output of the temperature sensor (solid line), while 702 shows the fan speed (dashed line).

At time T=0, the heat is turned on under the pot. The fan is OFF (0 rpm). The temperature rises gradually until the water begins to boil at 703, at which point it rises quickly. Detecting the rapid rise, the controller turns the fan ON to 2200 rpm at 704. As soon as the fan reaches speed, the temperature drops as a result. The temperature is now under control. Seeing that the temperature has dropped at 705, the fan speed is then reduced to 1500 rpm at 706. Once the fan speed drops, since the water is still boiling, the temperature shoots up again at 707. Seeing this rise, the controller increases the fan speed to 2300 at 708 which drives the temperature down to 67° at 709. Seeing this the fan speed is reduced and the temperature begins to rise again. Notice that all the while, the temperature under the hood is being maintained within a 3-4 degree range. At 710, the temperature rise triggers another fan increase at 711. At 712, the heat under the water is turned OFF, though the water continues to boil briefly. At 713, which is 600 seconds into the run, the controller goes into the "cooldown" mode because the temperature is no longer rising rapidly, which means the amount of heat coming from the stove is reduced. This mode allows the fan speed to continue dropping as long as the heat that is being exhausted by the fan exceeds the heat emitted by the stove. At 714, the speed drops all the way to 1230 rpm before it senses a heat rise. Fan speed is then increased again at 715, but only briefly as the controller continues to "search" and "locate" the heat level coming off the stove, based on the rate of temperature increase. Finally, at 716, sensing a "flattening out" of the heat rate, it continues to reduce the fan speed, incrementally, until it shuts off at 717. Thus, we have a controller that has the capability of monitoring an air quality parameter such as temperature and maintaining a ventilation rate sufficient to maintain temperature within a tight range while heat is being produced, and is then able to detect when the heat has stopped and shut itself off automatically. It is also capable of far smoother operation than any system that simply turns ON and OFF at prescribed temperature levels. Because it looks at heat rate, as well as the temperature, it is not affected by the ambient temperature in the installed location. Note that the fan stays ON throughout the entire incident, though the speed is modulated in response to the changing environment.

Figure 18:
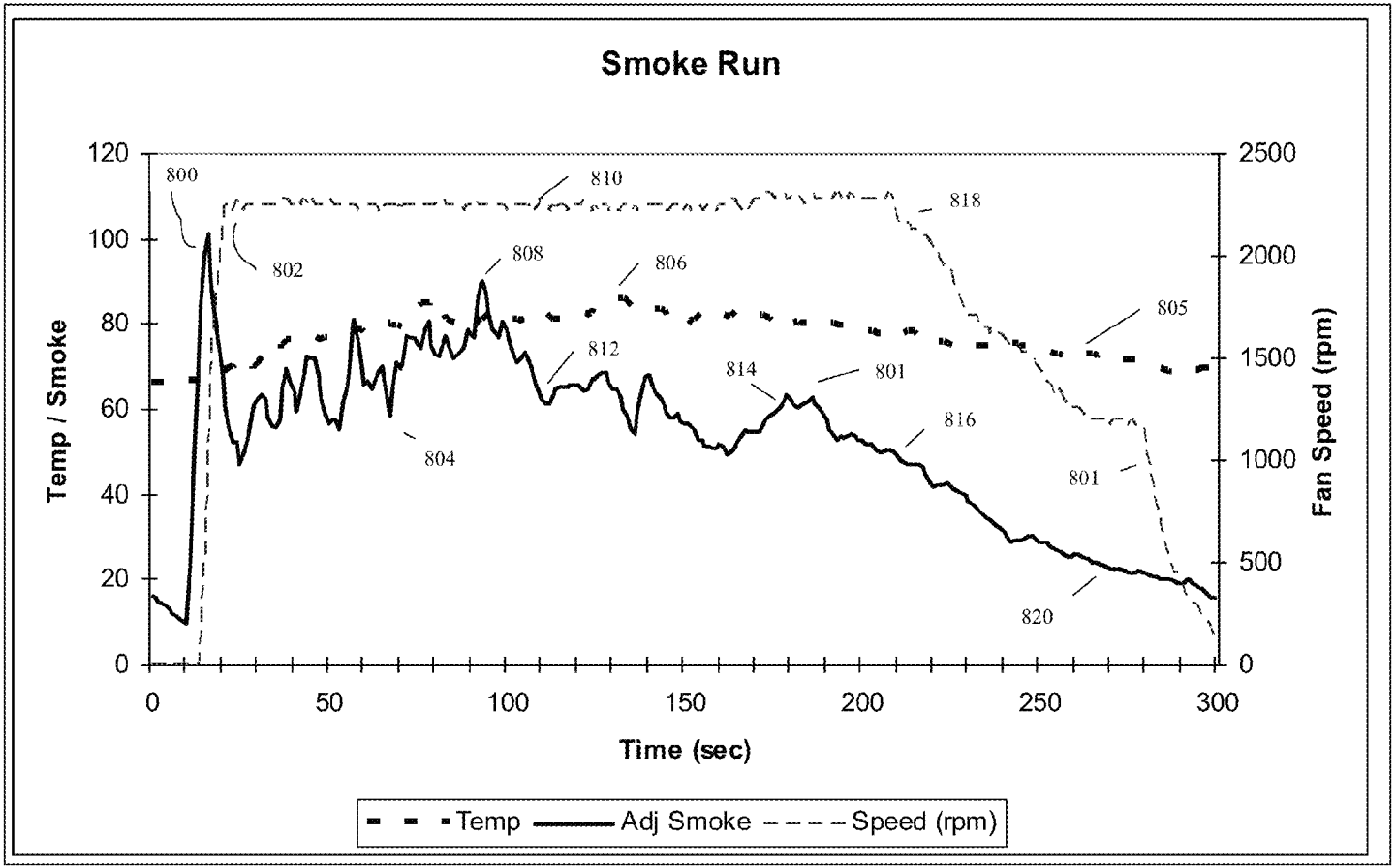
FIG. 18 is a time history chart showing one embodiment of the control system's response to the introduction of smoke into the hood.

FIG. 18 shows the performance of one embodiment of the hood in the case of smoking food. This time history shows the Temperature 805, Smoke level 820 and fan speed (rpm) 801 over a five minute interval beginning with smoking food being introduced beneath the hood for two minutes. After 16 seconds the smoke is detected as a peak of 100 units 800 which switches the fan on based on a differential rise in smoke level. Eight seconds later the fan is running at 2300 rpm 802. At this point the algorithm drives the fan at this level for 90 seconds while checking to see that the smoke remains with upper and lower limits. If the controller detects a certain level of smoke activity, it will reset the countdown timer so that it will run another 90 seconds. Otherwise, it will go into the cooldown mode. Since in this case there has been some increasing movement of the smoke level between points 804 and 808, the controller allowed the fan to continue running at 810. The smoke source begins to taper off at 812. In the second cycle, the controller saw a decrease in smoke level between 814 and 816, so it went into the cooldown cycle at 818. As the smoke level continued to drop, the controller continued to reduce the fan speed until it finally turned off just after 300 seconds. Since the heat rate was low, we saw modest temperature rise to a peak of 85 at 806. This was the point at which the heat balance tipped in favor of the heat being extracted exceeding the amount of heat being emitted, so that the temperature declined throughout the rest of the run, ending up at 69 degrees, which was close to ambient.

Figure 19:
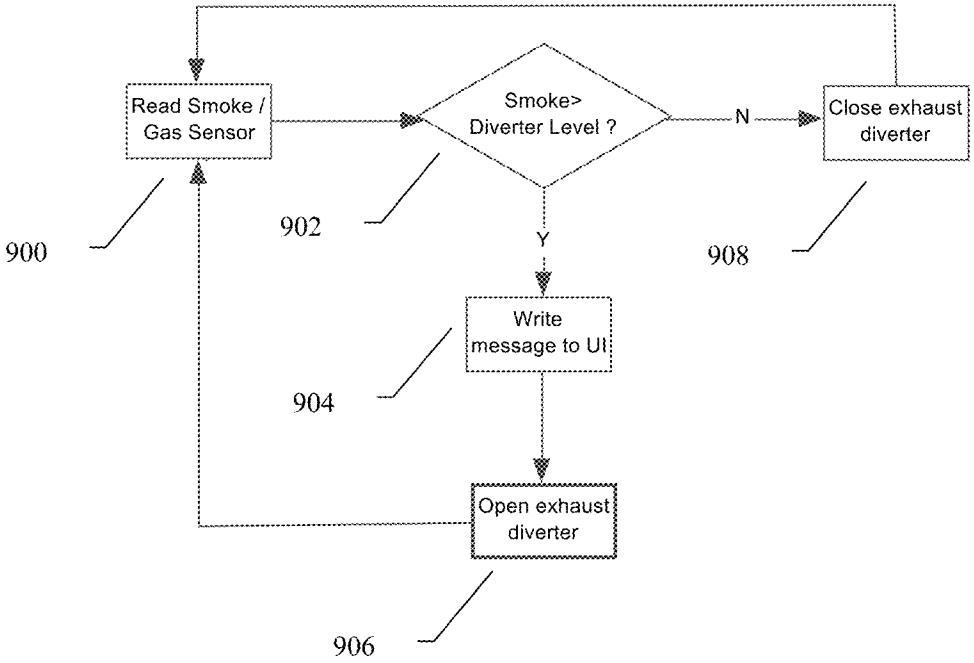
FIG. 19 is a flow chart of the operation of the Diverter Check subprogram.

FIG. 19 shows the operation of the Diverter Check routine. This is an energy conserving option that diverts the exhaust airflow from indoor to outdoor depending on the degree of contamination, By keeping the exhaust indoors except in cases of high contamination, energy, in the form of heated or cooled air is conserved. It is illustrated here in conjunction with the smoke sensor, but the operation could also be tied to any sensor, for example, CO, temperature, humidity, a combination, etc. At 900 the smoke sensor is read. If the level is found 902 to exceed the diverter level threshold, meaning that outdoor ventilation is required, a message indicating this action is sent to the user interface 904 and the diverter is activated 906. Control is returned to 900 and the loop is repeated. If the smoke level is below the diverter threshold 902, then the diverter is closed 908. The diverter can be opened and closed with any of a number of mechanisms including a solenoid and a spring, a linear actuator, increased airflow, etc.

Figure 20:
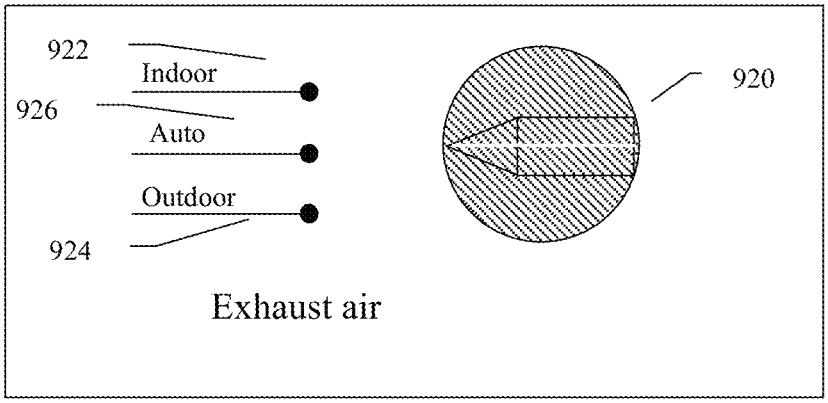
FIG. 20 shows one embodiment of a control panel switch that could be used with an automatic indoor/outdoor control option in conjunction with the Diverter Check subprogram.

FIG. 20 shows a front panel selector switch to be used with the energy saving flow diverter feature. Rotary knob 920 is used to select between the three exhaust flow options: Indoor 922, Outdoor 924, and Auto 926. In the Auto mode, the diverter check routine described above (FIG. 19) is used. Otherwise the flow is directed indoors or outdoors as selected. In this embodiment, an electrical actuator such as a solenoid would be used to open and close a flow damper. An alternative embodiment might use a mechanical device, such as a weighted damper that could open at or above a certain flow level.

With a software-based control system there are innumerable variations that can be implemented in terms of settings, timings and control responses. The control software programming technique can also be varied to include such approaches as fuzzy logic control, neural networks, proportional, differential, integral (PDI) control, etc. The number and types of trigger levels and rate detection schemes can also be varied. Alternative air quality sensors have already been mentioned. FIG. 3 shows a configuration with an external control module that could potentially be configured as an aftermarket add-on to an existing range hood. An additional configuration could include an alarm reset that kills the audible alarm and a fan reset that will quickly turn off the fan without the need to go into manual mode.

While the disclosed subject matter has been described with respect to a limited number of embodiments, the specific features of one embodiment should not be attributed to other embodiments of the disclosed subject matter. No single embodiment is representative of all aspects of the disclosed subject matter. Moreover, variations and modifications therefrom exist. For example, the disclosed subject matter described herein may comprise other components. Various additives may also be used to further enhance one or more properties. In some embodiments, the disclosed subject matter is substantially free of any additive not specifically enumerated herein. Some embodiments of the disclosed subject matter described herein consist of or consist essentially of the enumerated components. In addition, some embodiments of the methods described herein consist of or consist essentially of the enumerated steps. The claims intend to cover all such variations and modifications as falling within the scope of the disclosed subject matter.

What is claimed is:

1. A method for automatic control of range ventilation, designed to balance the objectives of maintaining air quality, reducing unnecessary loss of conditioned air and minimizing objectionable noise; the method comprising: configuring one or more sensors to sense one or more hazards generated in the operation of a residential cooking appliance; and communicate with a processor that executes an event detection program that, sensing information related to the one or more hazards by reading the sensor data with fan or fans off or at a predetermined minimal sampling air volume, and evaluating said data with respect to either set threshold levels or multiple sampling intervals of varying length, is able to detect the occurrence of a stove-related event such as a gas leak or the onset of cooking; and classify the event into one of several behavioral categories such as: threshold-exceeding, gradually-changing and rapidly-changing; wherein the step of determining a gradually or rapidly-changing category related to one or more hazards comprises monitoring any one or more parameters over one or more specified time intervals to see if the parameter reading has changed by a specified minimum amount during said interval; wherein the algorithm watches each parameter for X seconds, looking, as an example, for a rise of Y degrees, or Z % contamination, to determine a rate of change R1, wherein R1 might be gradual, R2 moderate, R3 rapid and so forth; these rates can then be communicated to a user or used to adjust response program parameters.

2. The method of claim 1, wherein the-step of determining the sensitivity of response Includes: reading a user-selected control setting adjusting the duration of sampling intervals during which the program looks for a sensed parameter change; thus, a user more concerned with safety can set the sensitivity high, while a user more concerned with reducing noise and energy use can set it lower.

3. The method of claim 1, wherein the step of determining a threshold-exceeded category comprises comparing sensor readings related to the one or more hazards to threshold levels that are adjusted relative to the ambient environmental conditions; the algorithm monitors ambient conditions around the clock, searching for a stable periods of at least T minutes to be used as a reference for the next time the algorithm is utilized; when run, the algorithm uses the most recent stable period as reference; once an event has been detected, calibration is locked until the event is cleared.

4. The method of claim 1, wherein the program provides the energy-saving option to direct exhaust indoors except when the sensors indicate the presence of potentially harmful effluents in which case the controller automatically opens a damper capable of diverting exhaust outside.

5. A method for automatic control of range ventilation designed to balance the objectives of maintaining air quality, reducing energy loss, and minimizing objectionable noise, incorporating: sensors to detect one or more air quality effects generated in the operation of a cooking appliance; and communicate with a processor that executes an event response program that oversees the response to a detected event including deployment of one or more alarms and control of the fan or fans to deliver ventilation airflow appropriate to a determined category comprising the following steps:

programmatically reducing the speed of at least one of the one or more fans; repeating the step of sensing information related to the one or more hazards via the sensors; to determine whether the event is unchanged, if it should be reclassified or if it has concluded, and controlling the one or more fans or alarms based on the appropriate response; wherein when periodic air sampling under controlled air flow reduction determines that the event has not concluded, the program returns to its entry point; when the event is determined to have concluded, the airflow is reduced to the initial condition, either off or at some sampling volume, and then the program terminates.

6. The method of claim 5 where the user can control the desired system behavior by specifying the intensity of response which adjusts variables that control fan speed associated with each category.

7. The method of claim 5 where the user can select the desired system behavior by specifying the duration of response which adjusts variables that determine when the event is considered to have concluded; this will impact the overall rate at which the fan speed will be reduced, in order to allow sensors to "listen" to the environmental factors.

8. A system for automatically controlling range ventilation designed to balance the objectives of maintaining air quality, reducing energy loss, and minimizing objectionable noise, the system comprising: sensors to detect one or more air quality effects generated in the operation of a cooking appliance; a processor that executes a control program with two distinct phases;

the first being a monitoring program that, by reading the sensor data with fan or fans off or at a predetermined minimal sampling air volume, and evaluating said data with respect to set threshold levels or sampling intervals for detecting rate of change, is able to detect the occurrence of a stove-related event such as a gas leak or the onset of cooking; and then classify the event into one of several behavioral categories such as: threshold-exceeded, gradually-changing and rapidly-changing;

the second, being a response program, takes over when an event has been detected, that oversees the response to said event including deployment of one or more alarms and control of the fan or fans to deliver ventilation airflow appropriate to the determined category, while programmatically reducing airflow in a controlled manner to enable periodic air sampling, while still ventilating, to determine whether the event is unchanged, if it should be reclassified and the response updated, or if it has concluded.

9. The system of claim 8, further comprising a control capable of accepting a user-selected input to adjust system behavior, wherein said control adjusts the duration of sampling intervals during which the program looks for a sensed parameter change, thus allowing a user more concerned with safety to set the sensitivity high, while a user more concerned with reducing noise and energy use can set it lower.

10. The system of claim 8, further comprising one or more additional sensors, wherein said one or more additional sensors are capable of sampling ambient elements related to the one or more hazards around the clock, searching for a stable periods of at least T minutes to determine a set of background conditions to be used as a reference for the next time the algorithm is utilized; when run, the algorithm uses the most recent stable period as reference; a threshold-exceeded category is determined by comparing sensor readings to threshold levels that are adjusted relative to said ambient reference levels; once an event has been detected, this calibration process is locked until the event is cleared.

11. The system of claim 8, where a gradually or rapidly-changing category is determined by monitoring any one or more parameters over one or more specified time intervals to see if the parameter reading has changed by a specified minimum amount, during said interval the algorithm watches each parameter for X seconds, looking, as an example, for a rise of Y degrees, or Z % contamination, to determine the rate of change R1, where R1 might be gradual, R2 moderate, R3 rapid and so forth; these rates can then be communicated to user and to adjust response program parameters.

12. The system of claim 8, further comprising a notification system capable of providing a notification, wherein said notification system comprises a user interface, colored lights, an alphanumeric display, an electronic remote messaging component, and/or an audible alarm.

13. The system of claim 12, further comprising a proximity unit capable of judging the proximity of the user, wherein the notification is adjusted based on the proximity of the user.

14. The system of claim 8, wherein the program provides the energy-saving option to direct exhaust indoors except when the sensors indicate the presence of potentially harmful effluents in which case the controller automatically activates a damper capable of diverting exhaust inside and outside to ensure that exhaust is directed outside.

15. The system of claim 8 where if periodic air sampling under controlled air flow reduction in phase 2 (the response program) determines that the event has not concluded, the program remains in phase 2; if the category of event has changed, the response is updated commensurate with the category; if the event is determined to have concluded, the airflow is reduced to the initial condition and control is returned to the first phase.

16. The system of claim 8 where the user can control the desired system behavior by specifying the intensity of response which adjusts variables that control fan speed associated with each category.

17. The system of claim 8 where the user can select the desired system behavior by specifying the duration of response which adjusts variables that determine when the event is considered to have concluded; this will impact the overall rate at which the fan speed will be reduced, in order to allow sensors to "listen" to the environmental factors.

* * * * *